US009180945B1

(12) United States Patent
Mears

(10) Patent No.: US 9,180,945 B1
(45) Date of Patent: Nov. 10, 2015

(54) SALVAGE RAIL FLOTATION DEVICE AND METHOD

(71) Applicant: Tony Mears, Longmont, CO (US)

(72) Inventor: Tony Mears, Longmont, CO (US)

( * ) Notice: Subject to any disclaimer, the term of this patent is extended or adjusted under 35 U.S.C. 154(b) by 60 days.

(21) Appl. No.: 13/776,495

(22) Filed: Feb. 25, 2013

Related U.S. Application Data

(60) Provisional application No. 61/602,749, filed on Feb. 24, 2012.

(51) Int. Cl.
*B63C 7/00* (2006.01)
*B63C 7/10* (2006.01)

(52) U.S. Cl.
CPC .... *B63C 7/10* (2013.01); *B63C 7/00* (2013.01)

(58) Field of Classification Search
CPC ..... B63C 7/00; B63C 7/06; B63C 7/10; B63C 7/12; B63C 7/28; B63C 2007/00; B63C 2007/06; B63C 2007/12; B63C 2007/125
USPC ..... 114/44, 50–54, 271, 283, 288, 290, 114/292, 364
See application file for complete search history.

(56) References Cited

U.S. PATENT DOCUMENTS

| | | | | | |
|---|---|---|---|---|---|
| 6,469 | A | * | 5/1849 | Lincoln | 114/49 |
| 151,400 | A | * | 5/1874 | Keeler et al. | 114/348 |
| 980,790 | A | * | 1/1911 | Johnson | 114/360 |
| 1,038,928 | A | * | 9/1912 | Menzel | 114/360 |
| 1,133,629 | A | * | 3/1915 | Foster | 114/68 |
| 1,220,876 | A | * | 3/1917 | Moore | 114/360 |
| 1,249,633 | A | * | 12/1917 | Jelercic | 114/360 |
| 1,375,055 | A | * | 4/1921 | Lodato | 114/68 |
| 1,622,508 | A | | 3/1927 | Harper | |
| D154,774 | S | | 8/1949 | Harris et al. | |
| 2,508,304 | A | | 5/1950 | Sturtevant | |
| 2,914,779 | A | | 12/1959 | Walker | |
| 2,924,192 | A | | 2/1960 | Salvage | |
| 3,092,853 | A | | 6/1963 | Owen | |
| 3,273,832 | A | | 9/1966 | Keedy | |
| 3,506,222 | A | | 4/1970 | Anderson | |
| 3,626,447 | A | * | 12/1971 | Hindlin | 405/221 |
| 3,822,662 | A | * | 7/1974 | Morita et al. | 114/123 |
| 3,952,350 | A | * | 4/1976 | Moucka | 441/41 |
| 4,298,177 | A | | 11/1981 | Berlongieri | |
| 4,389,961 | A | | 6/1983 | Parish | |
| 4,458,618 | A | | 7/1984 | Tuffier | |
| 4,495,880 | A | | 1/1985 | Maniscalco et al. | |
| 4,517,914 | A | | 5/1985 | Geracitano | |
| 4,545,319 | A | | 10/1985 | Ferronniere et al. | |
| 4,655,415 | A | | 4/1987 | Miller et al. | |
| 4,667,618 | A | | 5/1987 | Cigognetti | |
| 4,678,443 | A | | 7/1987 | Edwards et al. | |
| 4,723,929 | A | | 2/1988 | Parish | |
| 4,817,555 | A | * | 4/1989 | Meinen | 114/360 |
| 4,864,961 | A | * | 9/1989 | Slonski | 114/360 |

(Continued)

FOREIGN PATENT DOCUMENTS

| | | |
|---|---|---|
| DE | 3530618 | 3/1987 |

*Primary Examiner* — Daniel V Venne
(74) *Attorney, Agent, or Firm* — Trenner Law Firm, LLC; Mark D. Trenner

(57) ABSTRACT

The invention provides a salvage rail which connects to an object such as a sunken ship, a sinking ship, a seaworthy ship that wants to have protection so that it will not sink, or countless other objects that are in water. Rolled-up bags, or bladders, which can be inflated, are configured on the rail. The rail is easy to handle, even with rolled bags included.

15 Claims, 30 Drawing Sheets

(56) References Cited

U.S. PATENT DOCUMENTS

| | | | | | |
|---|---|---|---|---|---|
| 4,867,094 | A | | 9/1989 | Binks | |
| 4,996,936 | A | * | 3/1991 | Brundritt | 114/68 |
| 5,102,070 | A | | 4/1992 | Smialowicz et al. | |
| 5,150,662 | A | | 9/1992 | Boyd et al. | |
| 5,215,031 | A | | 6/1993 | Inman et al. | |
| 5,357,888 | A | * | 10/1994 | Insinna | 114/69 |
| 5,743,786 | A | | 4/1998 | Lindsey | |
| 5,765,778 | A | | 6/1998 | Otsuka | |
| 5,906,530 | A | | 5/1999 | Lindsey | |
| 6,070,546 | A | | 6/2000 | Downey et al. | |
| 6,161,494 | A | * | 12/2000 | Pontevolpe et al. | 114/219 |
| 6,343,562 | B1 | * | 2/2002 | Ingram | 114/347 |
| 6,431,108 | B1 | | 8/2002 | Lopez-Perea Lloveres et al. | |
| 6,435,125 | B2 | | 8/2002 | Mears | |
| 6,470,818 | B1 | | 10/2002 | Mears et al. | |
| 6,484,656 | B2 | * | 11/2002 | Mears et al. | 114/68 |
| 6,598,550 | B1 | * | 7/2003 | Patel | 114/54 |
| 6,612,256 | B1 | * | 9/2003 | Martin | 114/360 |
| 6,802,274 | B2 | * | 10/2004 | Mears et al. | 114/68 |
| 6,810,827 | B2 | * | 11/2004 | Hansen | 114/345 |
| 6,814,019 | B2 | * | 11/2004 | Mears et al. | 114/68 |
| 6,830,004 | B2 | | 12/2004 | Mears et al. | |
| 6,845,726 | B2 | | 1/2005 | Mears et al. | |
| 7,069,873 | B2 | * | 7/2006 | Seidel | 114/360 |
| 7,156,033 | B2 | * | 1/2007 | Mears et al. | 114/68 |
| 7,337,744 | B2 | * | 3/2008 | Marcellus | 114/360 |
| 8,096,257 | B2 | * | 1/2012 | Schmitt | 114/345 |
| 8,721,224 | B2 | * | 5/2014 | Hough | 405/215 |

* cited by examiner (5 Foot Plastic)

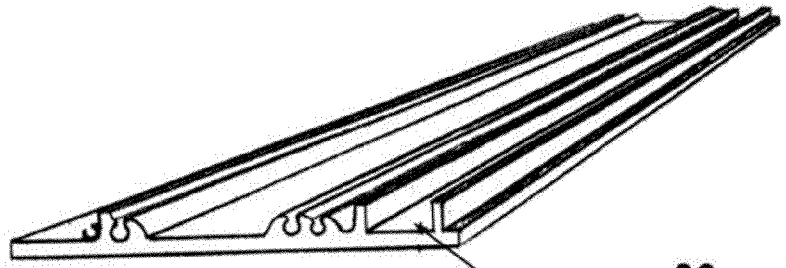
Figure 10
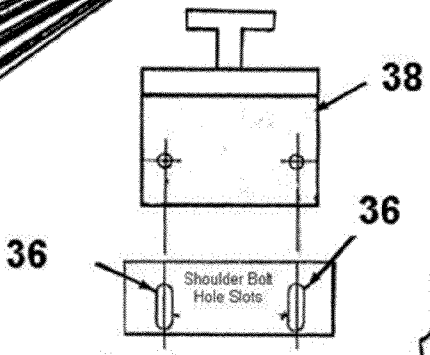
Figure 11
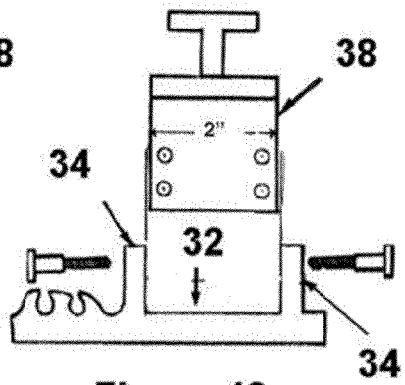
Figure 12
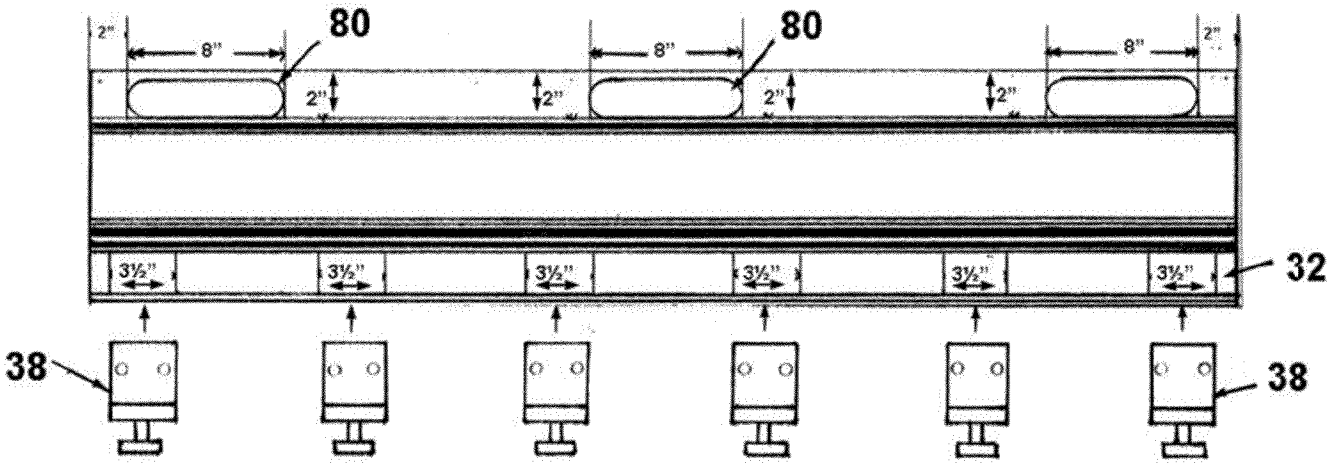
Figure 13 (5 Foot Plastic)

(10 Foot Plastic)

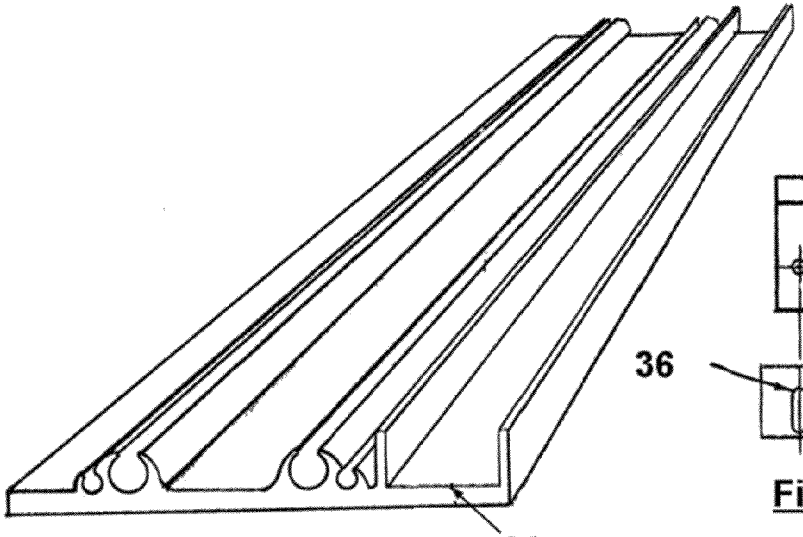
Figure 15
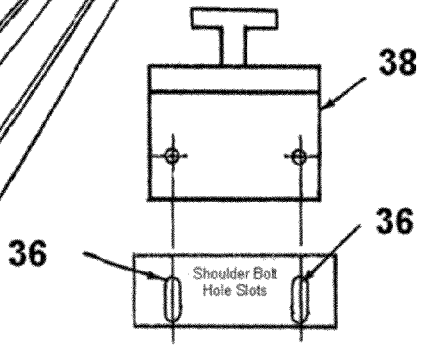
Figure 16
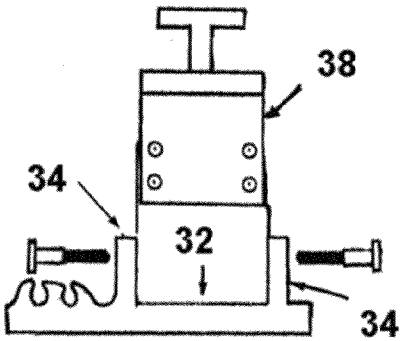
Figure 17
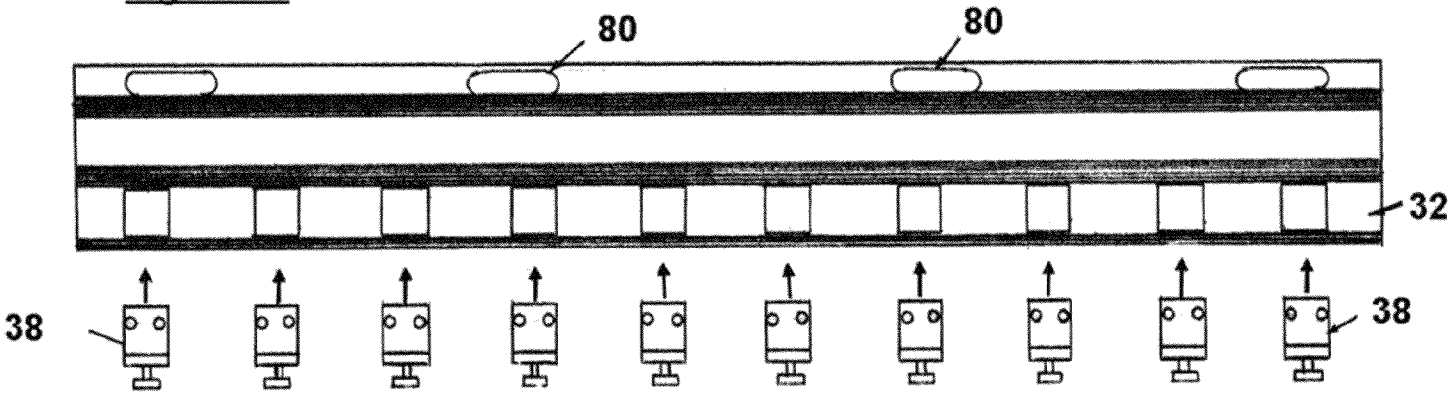
Figure 18 (10 Foot Plastic)

(5 Foot Aluminum)

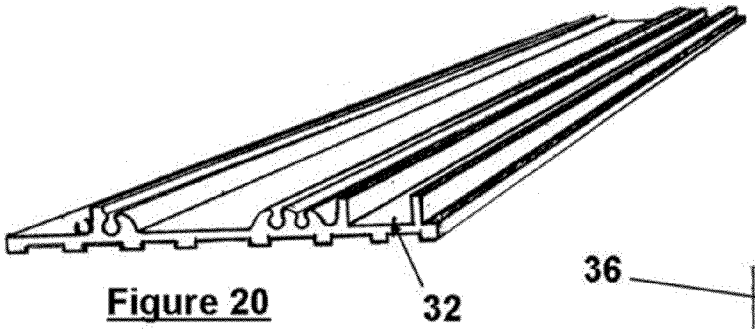
Figure 20
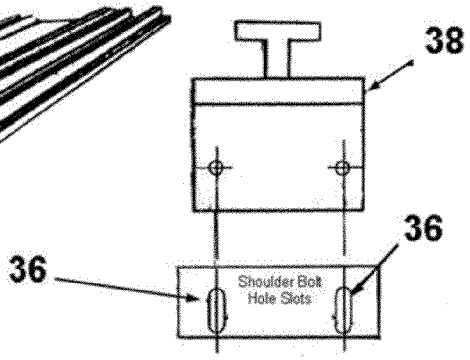
Figure 21
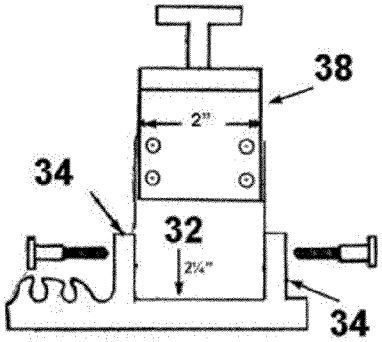
Figure 22
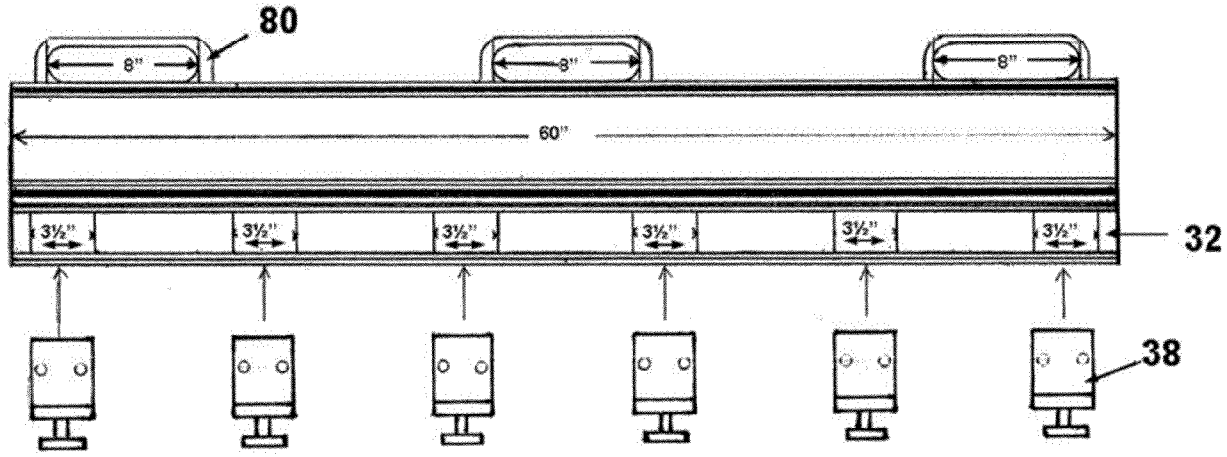
Figure 23 (5 Foot Aluminum)

(10 Foot Aluminum)

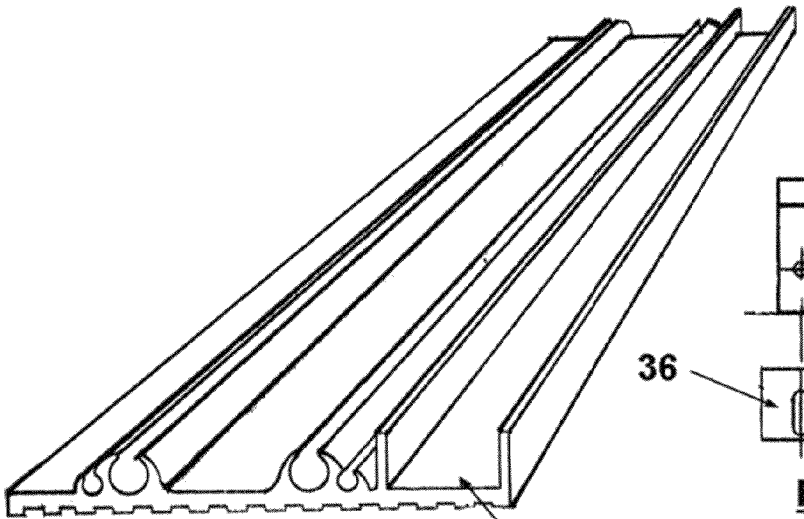
Figure 25
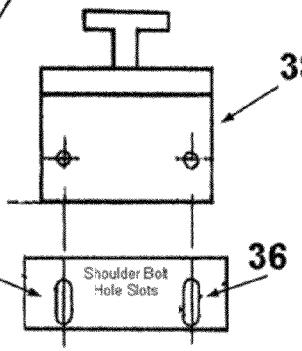
Figure 26
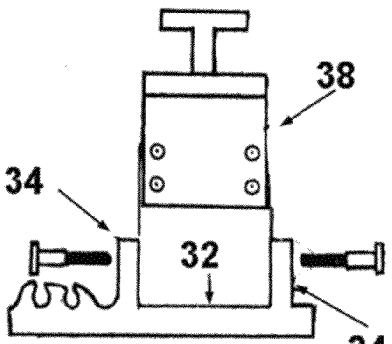
Figure 27
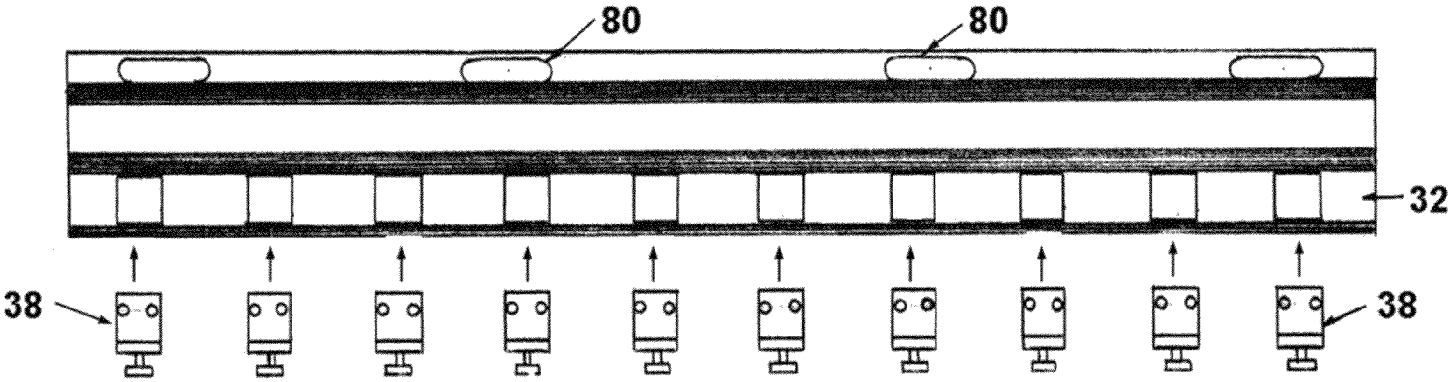
Figure 28 (10 Foot Aluminum)

(Plastic)

SALVAGE RAIL FLOTATION DEVICE AND METHOD

CLAIM OF PRIORITY

This patent application claims priority under 35 USC 119 (e) (1) from U.S. Provisional Patent Application Ser. No. 61/602,749 filed Feb. 24, 2012, of common inventorship herewith entitled, "Magrail."

FIELD OF THE INVENTION

The present invention relates to inflatable flotation devices for watercraft or submerged items, and more particularly, to devices for attachment to the hull of a compromised watercraft and to increase buoyancy to allow a sinking or sunken craft to be raised to the surface for towing.

BACKGROUND OF THE INVENTION

The prior art has put forth multiple designs for inflatable flotation devices for watercraft. Among these are:

U.S. Pat. No. 6,845,726 directed to an Inflating Watercraft Flotation Device of Tony W. Mears, et al which describes a flotation device for attachment to a water craft comprising a cover releasably secured to the watercraft.

U.S. Pat. No. 6,470,818 to Arthur W. Mears, Nicolae Toderica and Valerica Grigore describes an automatic inflating watercraft flotation device comprising a carrier mounted to the watercraft, the carrier having a first cover channel, a second cover channel, a first bladder retaining slot and a second bladder retaining slot.

U.S. Pat. No. 6,830,004 to Tony W. Mears, et al, describes an inflating watercraft flotation device comprising a mounting plate mounted to the watercraft, with the mounting plate having a first cover channel, a second cover channel, a first bladder retaining slot and a second bladder retaining slot.

None of these references describe the present invention.

SUMMARY OF THE INVENTION

It is an object of the present invention to provide a device for attachment to the hull of a watercraft for adding buoyancy to the watercraft.

It is a further object of the present invention to provide a device for attachment to the hull of a watercraft or submerged item for adding buoyancy to the watercraft or submerged item.

It is a further object of the present invention to provide multiple novel attachment means for attaching a salvage rail to a watercraft or submerged item.

It is a still further object of the present invention to provide a device for preventing shear movement of a magnet.

It is a still further object of the present invention to provide a reusable inflatable salvage bag that can be rolled up and put under a cover.

The present invention provides a rail, also hereinafter referred to as a salvage rail which connects to an object such as a sunken ship, a sinking ship, a seaworthy ship that wants to have protection so that it will not sink, or countless other objects that are in water. Rolled-up bags, or bladders, which can be inflated, are configured on the rail. The rail is easy to handle, even with rolled bags included.

BRIEF DESCRIPTION OF THE DRAWINGS

FIG. 10 is a front longitudinal perspective view of the five foot plastic salvage rail.

FIG. 11 is a side view of a magnet above the magnet holder (magnet holding channel) aligning with shoulder bolt slots in the channel's flanges.

FIG. 12 is a front view of the magnet holder (magnet holding channel) showing the placement of the shoulder bolts through holes in the channel flanges. The bolts will screw into the tapped holes of the magnet once the magnet is seated completely in the channel.

FIG. 13 is a top view of the five foot plastic salvage rail.

FIG. 15 is a front longitudinal perspective view of the ten foot plastic salvage rail.

FIG. 16 is a side view of a magnet above the magnet holder (magnet holding channel) aligning with shoulder bolt slots in the channel's flanges.

FIG. 17 is a front view of the magnet holder (magnet holding channel) showing the placement of the shoulder bolts through holes in the channel flanges. The bolts will screw into the tapped holes of the magnet once the magnet is seated completely in the channel.

FIG. 18 is a top view of the ten foot plastic salvage rail.

FIG. 20 is a front longitudinal perspective view of the five foot extruded aluminum salvage rail.

FIG. 21 is a side view of a magnet above the magnet holder (magnet holding channel) aligning with shoulder bolt slots in the channel's flanges.

FIG. 22 is a front view of the magnet holder (magnet holding channel) showing the placement of the shoulder bolts through holes in the channel flanges. The bolts will screw into the tapped holes of the magnet once the magnet is seated completely in the channel.

FIG. 23 is a top view of the five foot extruded aluminum salvage rail showing the channels for receiving six magnets.

FIG. 25 is a front longitudinal perspective view of the ten foot extruded aluminum salvage rail.

FIG. 26 is a side view of a magnet above the magnet holder (magnet holding channel) aligning with shoulder bolt slots in the channel's flanges.

FIG. 27 is a front view of the magnet holder (magnet holding channel) showing the placement of the shoulder bolts through holes in the channel flanges. The bolts will screw into the tapped holes of the magnet once the magnet is seated completely in the channel.

FIG. 28 is a top view of the ten foot extruded aluminum salvage rail showing the channels for receiving ten magnets.

DETAILED DESCRIPTION OF THE INVENTION

The rail, or salvage rail, of the present invention provides inflatable bladders or bags 46, 48 mounted on a rail 12 and the rail 12 is attachable to the surface of an object or target which requires buoyancy. As used herein, the term "rail" is equivalent to the term "salvage rail." The profile of the whole rail assembly is such that a boat, ship, barge, or oil derrick can operate with a number of non-activated rails or salvage rails 12 attached to its sides without affecting its normal functions. For undersea applications, the rail assembly can be handled by divers or underwater vehicles with relative ease.

Figures 1, 2:
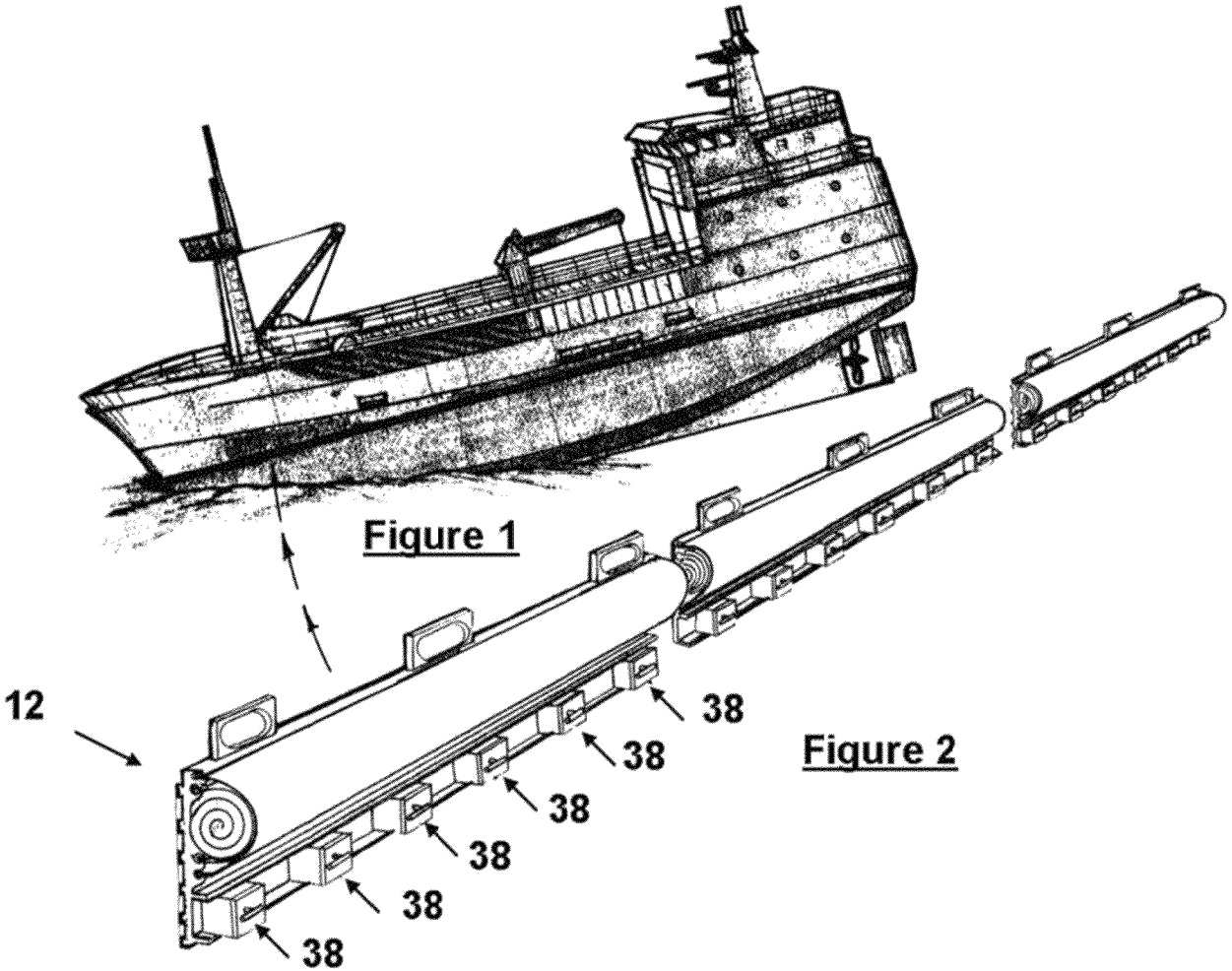
FIG. 1 is a side view of a watercraft that has sunk and is lodged in the bottom.
FIG. 2 is a diagonal front view of the salvage rail of the present invention which will be mounted to the hull of the sunken watercraft.
Figure 3:
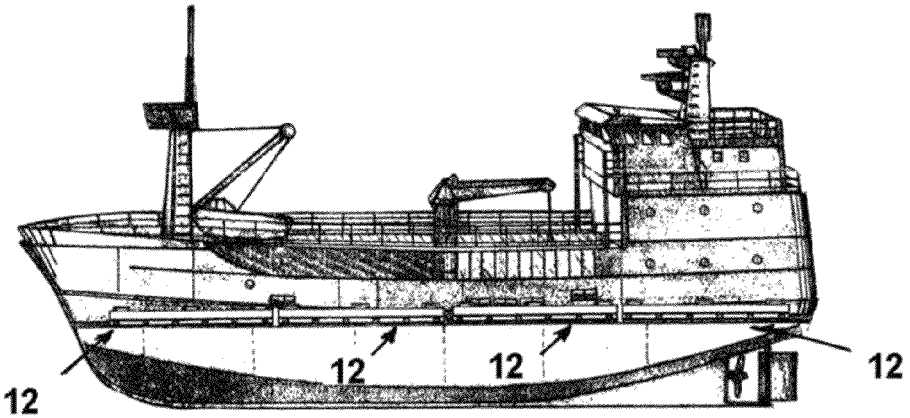
FIG. 3 is the side view of the watercraft with the salvage rail of the present invention mounted on the side of the watercraft.
Figure 4:
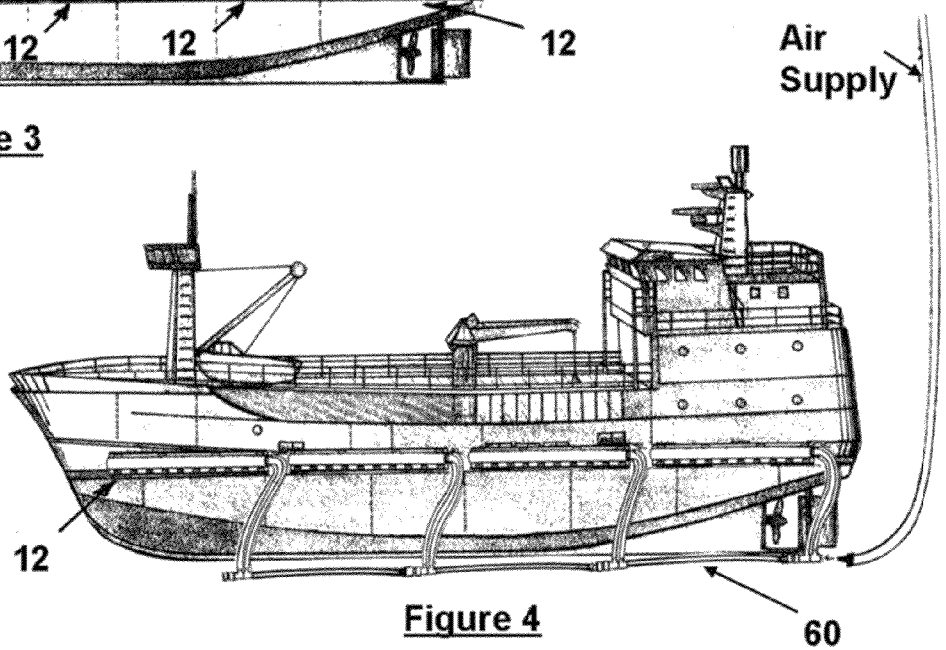
FIG. 4 is the side view of the watercraft with the salvage rail and air supply manifold assembly of the present invention mounted on the side of the watercraft. The air supply manifold is attached to all of the air intake ports of the bladders via quick connect connectors.
Figure 5:
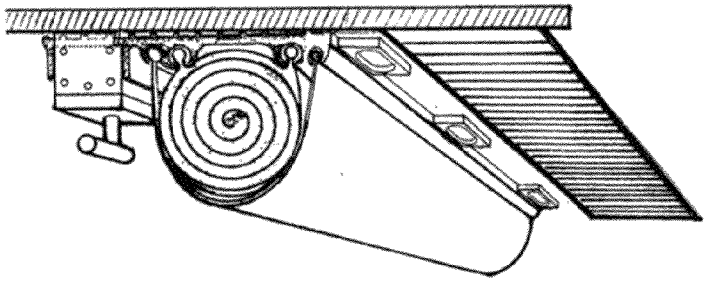
FIG. 5 is a side close up end view of the salvage rail of the present invention with the inflatable bladders rolled up.
Figure 6:
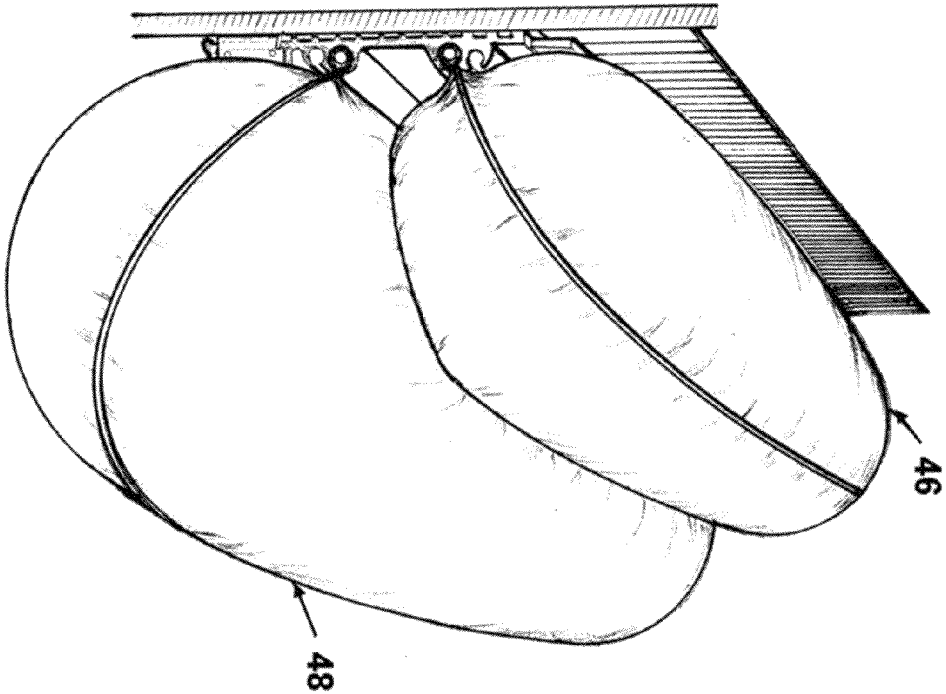
FIG. 6 is a side close up end view of the salvage rail of the present invention with the bladders inflated.
Figure 7:
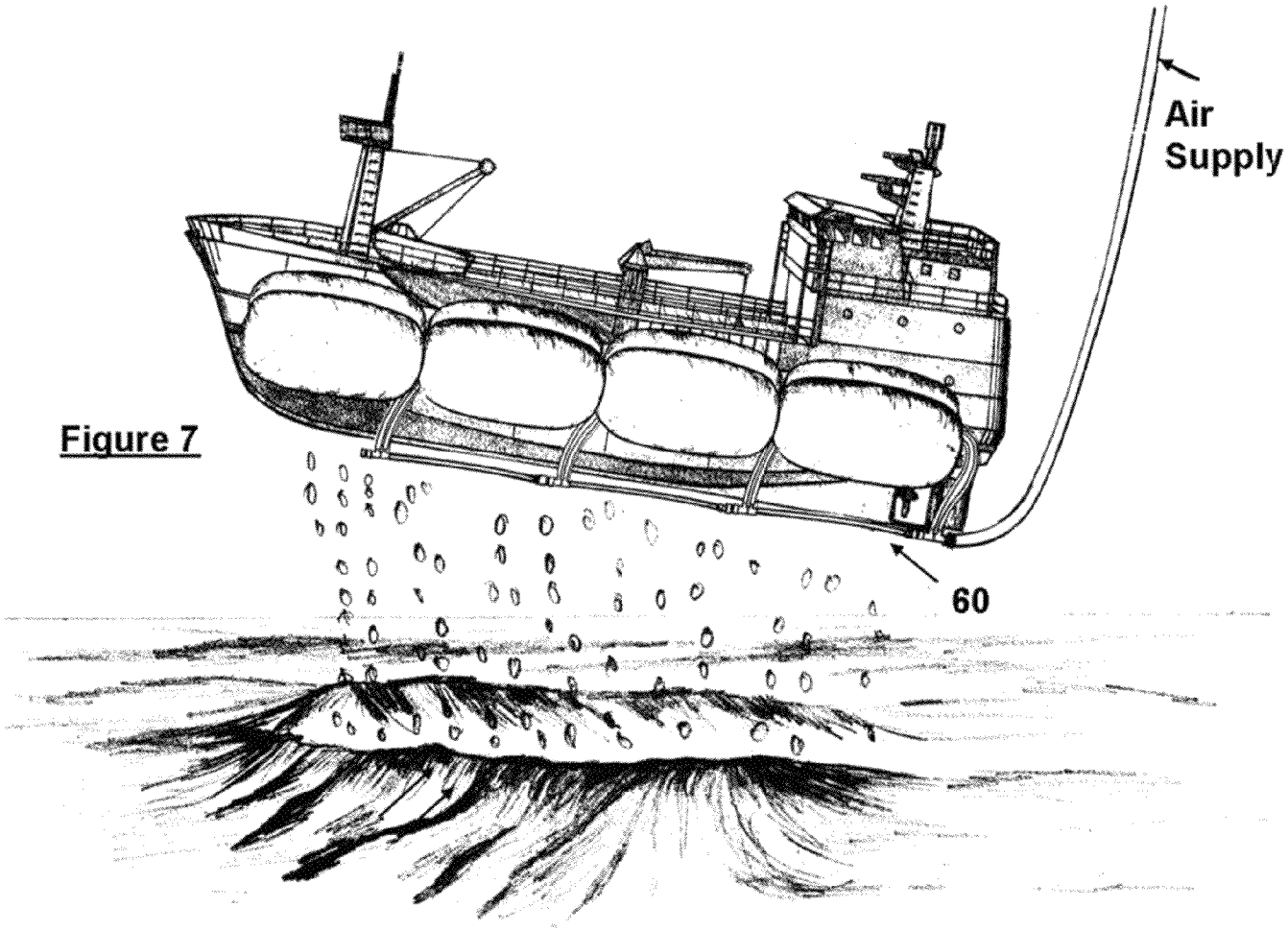
FIG. 7 is a side view of a recovered watercraft floating to the water's surface having salvage rails mounted thereon, with the inflatable bladders inflated.
Figure 8:
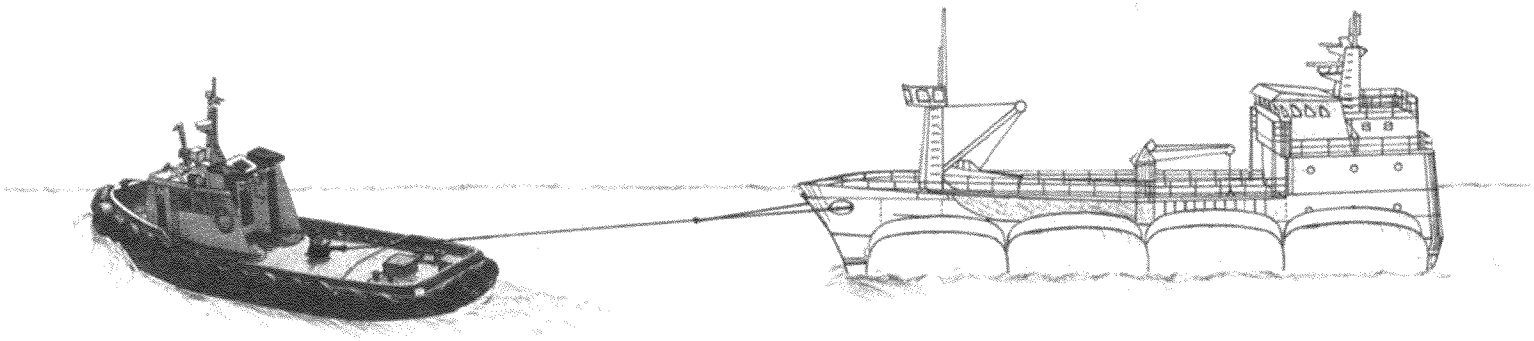
FIG. 8 shows a recovered watercraft, with salvage rails mounted thereon, and bladders inflated, being towed by a tugboat.

FIG. 1 shows a watercraft that has sunk. FIG. 2 shows a series of three salvage rails 12 which will be attached to one side of the watercraft. Each salvage rail 12 shows six magnets 38. FIG. 3 and FIG. 4 show side views of the salvage rail 12 attached to the side of the watercraft, with FIG. 4 also depicting an air supply manifold 60 attached to the quick connect connectors 62 located on the ends of bladders 46, 48. At this point, all of the bladders 46, 48 are rolled up. FIG. 5 presents a close up of the un-inflated bladders 46, 48 on a salvage rail 12, while FIG. 6 shows the same bladders 46, 48 that have been inflated. FIG. 7 shows the previously sunken watercraft floating toward the surface as the inflated bladders 46, 48 of the attached salvage rails 12 provide required buoyancy. FIG. 8 shows the watercraft being towed. As used herein, the terms "bladder" and "airbag" are equivalent to the term "bag."

Since different objects, or floatation "targets", exist in various sizes, the rail can be provided in a number of lengths: 5 feet, 10 feet, for example. The term "target" refers to anything that needs to be floated. Floatation bags or bladders that accompany the rail come in sizes commensurate with the rail size, that is, 5-foot bags for the 5-foot rail, for example. Choosing the length of the rail, and number of rails, is dictated by the size and weight of the target. Since the floatation bags are rated for the amount of buoyancy they produce (for example, 1 ton or 5 tons), designing a floatation system is straightforward. Simply add rails until the total amount of the rated buoyancy surpasses the weight of the target. The target will then float when the bags are inflated.

Figure 9:
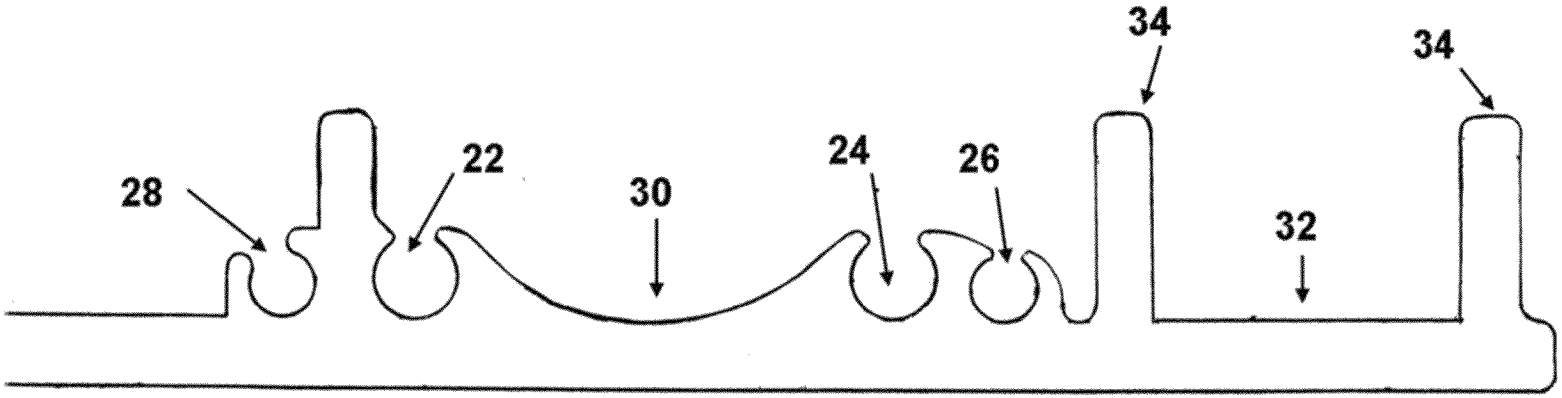
FIG. 9 is a cross-sectional view of the plastic salvage rail in the five foot size.
Figure 14:
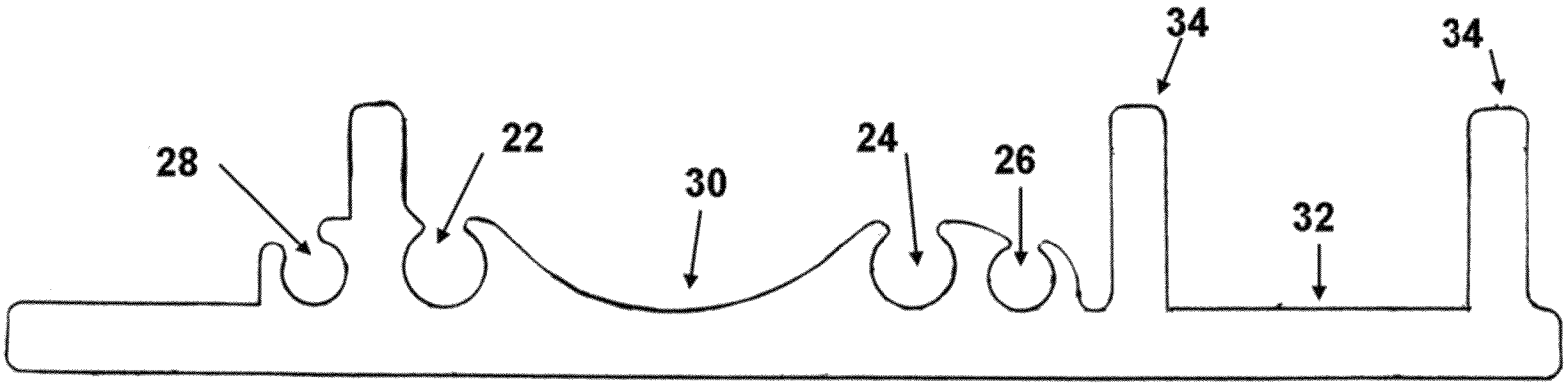
FIG. 14 is a cross-sectional view of the plastic salvage rail in the ten foot size.

FIG. 9 is a cross-sectional view of a five foot long plastic salvage rail. The salvage rail has four channels, which extend for the entire length of the rail as shown in FIG. 10. The first and second channels are close together and the third and fourth are close together. The first two channels are spaced apart from the second two channels creating a trough 30 between the pairs of channels. Traversing the rail from left to right, the first channel is the cover releasable retainment channel 28. The second channel is the small bag containment channel 22. Next to channel 22 is the trough 30. The trough 30 receives the rolled up bags. While the trough 30 performs the same function in both aluminum and plastic rails 12, it has a slightly different contour in the aluminum and plastic designs. The trough 30 of the plastic rail 12 is more concave, or semi-circular, as compared to the trough 30 of the aluminum rail 12 which is flatter, or less recessed. (See FIG. 15 for an aluminum rail 12 example.) Next to trough 30 is large bag containment channel 24, and next to channel 24 is the (non-releasable) cover retainment channel 26. Next to the channels is the magnet holder 32 which is the space between the two magnet holder flanges 34. The magnet holder flanges 34 each have shoulder bolt hole slots 36 for securing magnet 38 into the magnet holder 32.

Figure 32:
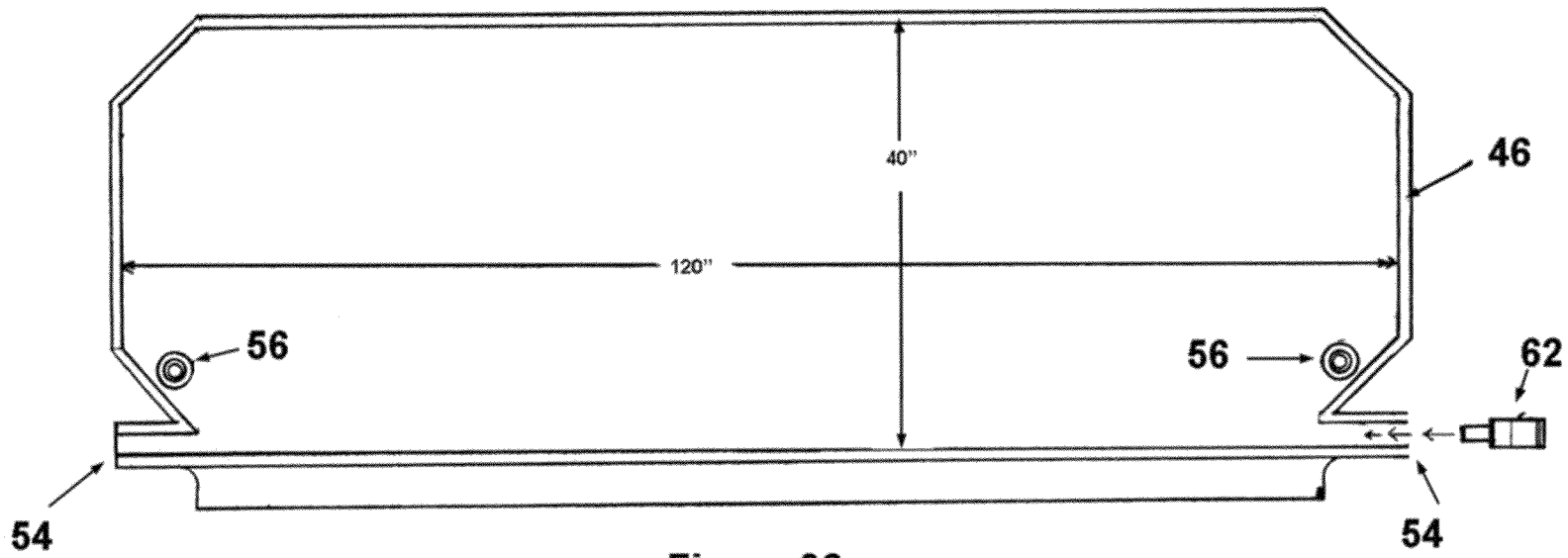
FIG. 32 is a front view showing the unrolled (deflated) small bladder with air intake ports, pressure relief valves, and the female end of a quick connect connector with integral check valve on a ten foot rail.
Figure 33:
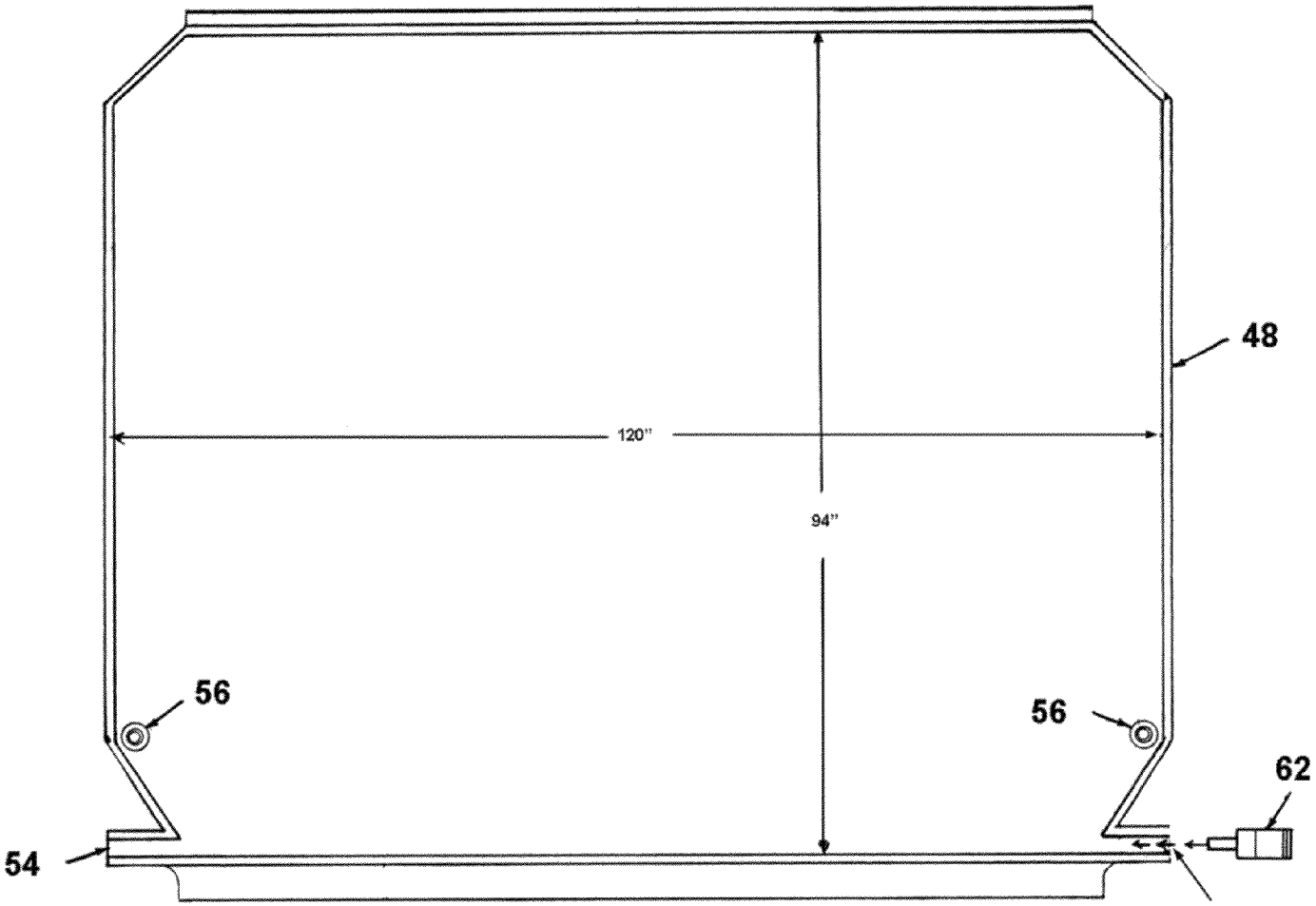
FIG. 33 is a front view showing the unrolled (deflated) large bladder with air intake ports, pressure relief valves, and the female end of a quick connect connector with integral check valve on a ten foot rail.

FIG. 32 shows a front view of the small bag and FIG. 33 shows a front view of the large bag. The bag and cover are made of Dacron™ coated with mold resistant PVC. The large bag is mounted below the small bag. The simultaneous inflation of all bags allows the small upper bag 46 to act as a "leverage bag" thereby forcing the large bag 48 down, thereby lifting the target higher out of the water.

Just as floatation targets come in various sizes and weights, they are also constructed of different materials. Therefore, the present invention provides a number of attachment means. That way, rails can be quickly attached to both metal and non-metal targets. Magnets, powder-actuated fasteners 68 and powerful suction cups 58 can be used, for example.

Figure 54:
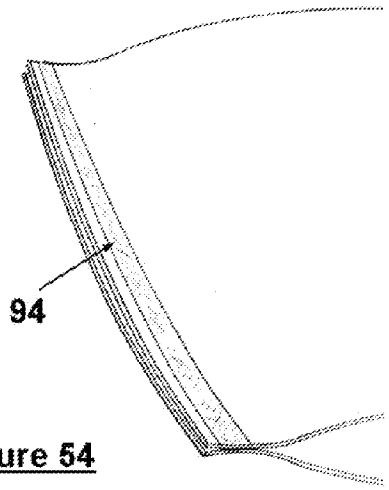
FIG. 54 is an exploded view of the inflatable bag.
Figures 55, 56:
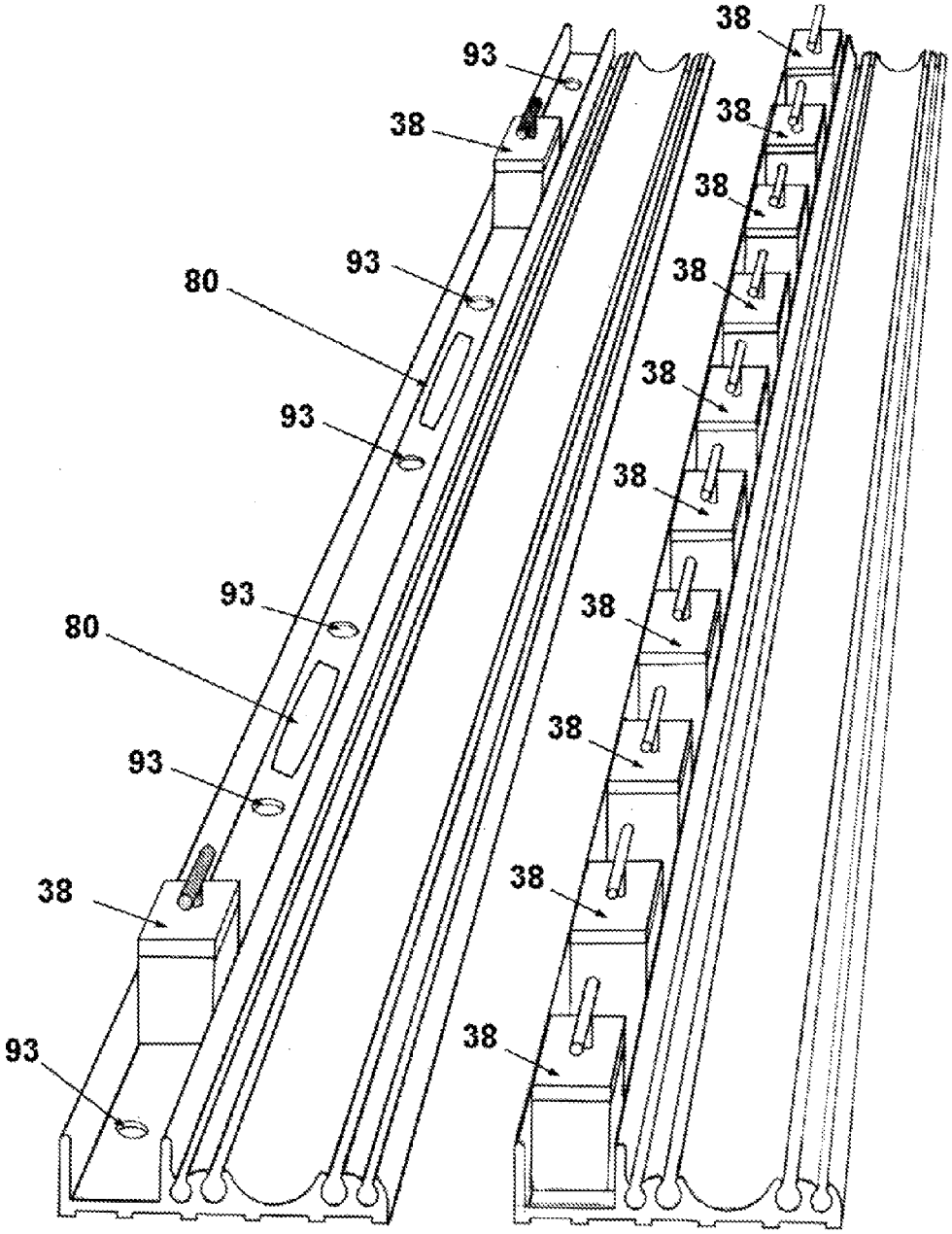
FIG. 55 is a front longitudinal perspective view of the salvage rail.
FIG. 56 is a front longitudinal perspective view of the salvage rail.
Figure 57:
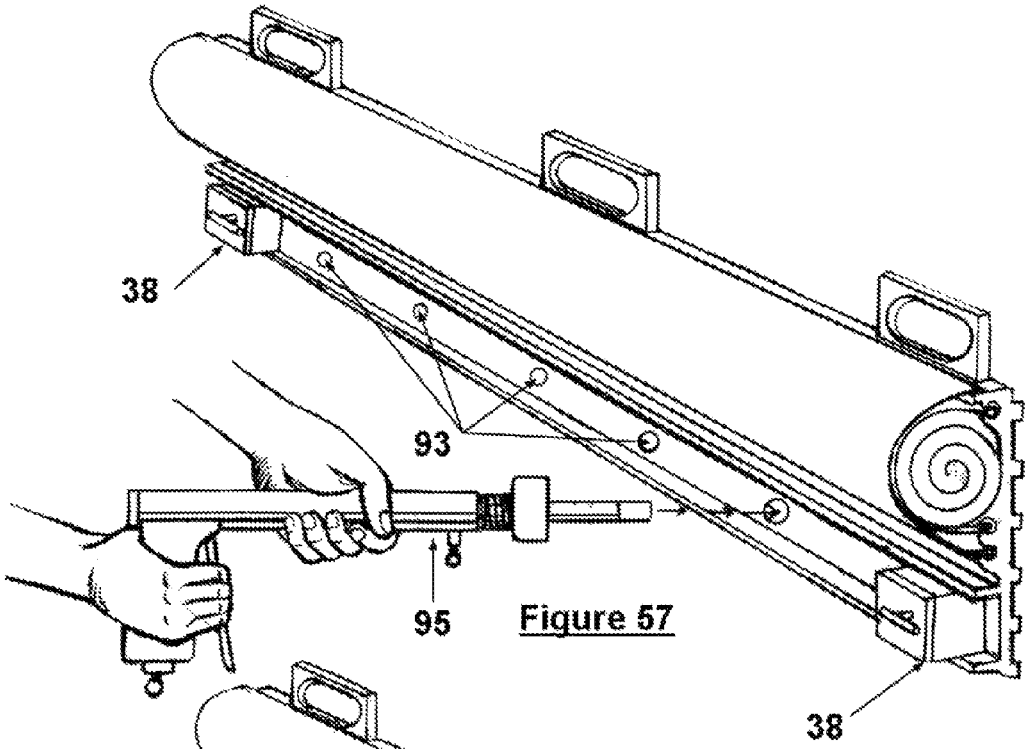
FIG. 57 is a side perspective view showing the powder actuated tool.
Figure 58:
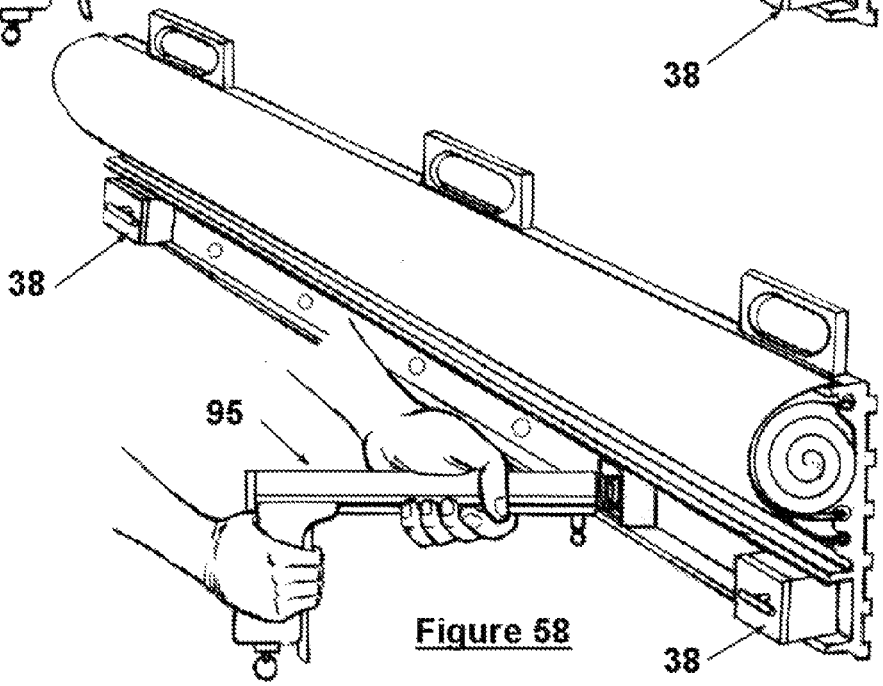
FIG. 58 is a side prospective view showing the powder actuated tool.
Figure 59:
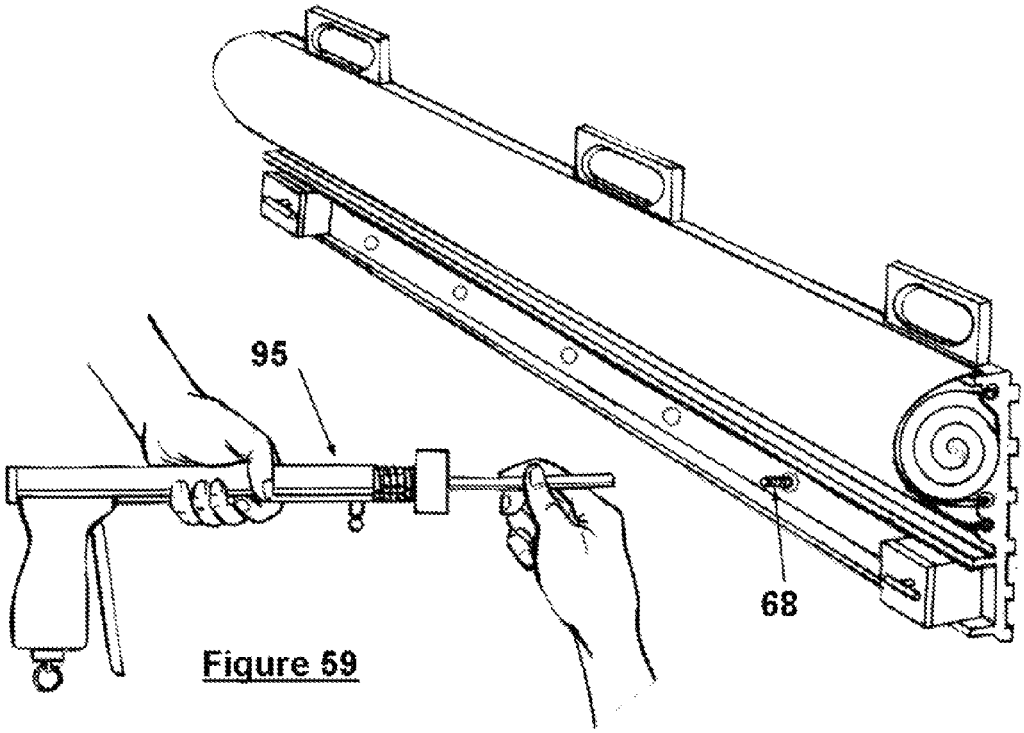
FIG. 59 is a side prospective view showing the removal of the powder charge tube from the tool.
Figure 60:
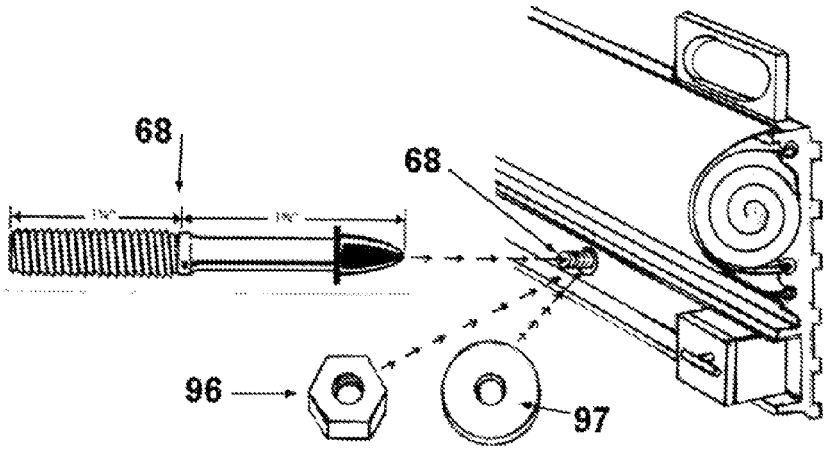
FIG. 60 is a exploded view of the fastener protruding from the opening on the rail to secure it to the vessel being lifted.

One possibility shown in FIG. 54 is that two magnets are used to hold the rail in position the rail on the target and powder actuated fasteners 68 are used to completely secure the rail onto the target.

Like the attachment techniques, a number of methods can be used to inflate the rail's inflation bags. Air compressors and pumps can be used from surface vessels or shore facilities, air tanks can be directly applied underwater, pyrotechnic devices can be employed, or combinations of these can be used based on the application or situation.

Rail assemblies are provided with hoses, and standard connectors and fittings to interface between the rail's floatation bags and the air supplies. Hose air intake manifolds are included for floatation configurations that must include multiple rail assemblies mounted adjacent to each other. The air intake manifolds allow all the bags of the floatation configuration to be inflated simultaneously to produce the required amount of buoyancy to lift a large target, or keep it upright on the surface.

The salvage rail of the present invention provides a quick-connecting, light metal (extruded aluminum), or plastic, sleek-profile rail that neatly carries rolled, deflated, air bags. The rail assembly is attached to the sides of a salvage "target", and the bags are inflated at that location: The present invention offers fast and convenient set-up, and also brings substantial lift and support capability, as well as the ability to stabilize the object at the surface of the water. This last characteristic is novel in that prior art air bags (that are big and bulky and difficult to position and attach to salvage targets underwater, to begin with) can only lift an object effectively to the surface. Because the prior art bags are strapped to the target underwater in any way possible, the target most probably will reach the surface sitting too high or too low in the water, or may not be level, may be leaning to one side or the other. The result is that most prior art salvage operations do not allow the target to be towed directly after floatation. In many typical cases, a large crane and barge are used to raise the target from the water and move it to shore, respectively.

Initially, the salvage rail of the present invention will come in two lengths (5' and 10') and offer three (3) attachment methods. Once rail assemblies are in place underwater, airbags raise the salvage target to the surface and then stabilize it for direct transport. This is accomplished in a straightforward way since the salvage rails are mounted underwater at vertical heights along the sides of the target that will float the target squarely and position it above the waterline, where it is then stable for towing. For especially difficult situations, where the salvage target is lying askew in the bottom, some additional salvage rails, or small independent air bags can be mounted initially on the target to level it. Once level it can then be floated to the surface so that it may be towed immediately.

The rail of the present invention can be mounted to a target by several methods. The rail has a designated top and bottom, and is mounted horizontally. Mounting can accommodate some variations in the salvage target's outer surface, as the extruded aluminum rail is ridged and may be conformed to fit. For typical recovery of steel targets, the salvage rail assembly parts suite includes two switchable on-off magnets 38 (each with 1000 pounds of hold force), which are turned on for fast and precise positioning of the rail. Magnets suitable for use for this purpose include rare earth metal magnets such as neodymium magnets such as the MAGSQUARE™ 1000 available from Magswitch Company (Denver, Colo.) at Magswitch.com, for example. The casing of the magnet 38 can be coated to prevent corrosion in water or salt water with a material such as RHINO™ liner or LINE-X™. The magnetic surface itself may be coated with vinyl or other passivation material to prevent corrosion in water or salt water. The rail 12 is positioned, and the magnets 38 are turned on mechanically with a 180 degree turn of a magnet engagement handle 40. Depending on the condition of the target, surface preparation may be required to establish the magnetic connection. The rail 12 is then secured with threaded fasteners 68 which are fired in to provide a secure hold.

Figure 38:
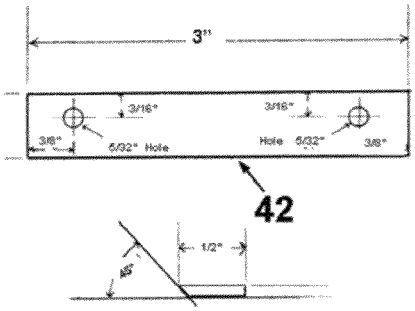
FIG. 38 is a front view of the shear blade which will be attached to the magnet to prevent shear force from moving the magnet.
Figure 39:
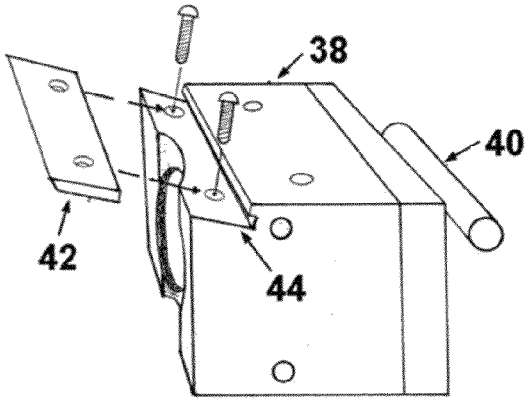
FIG. 39 is a side perspective view of a magnet having a notch cut into the magnet and the shear blade being fitted onto the notch in the magnet and held by screws.
Figure 40:
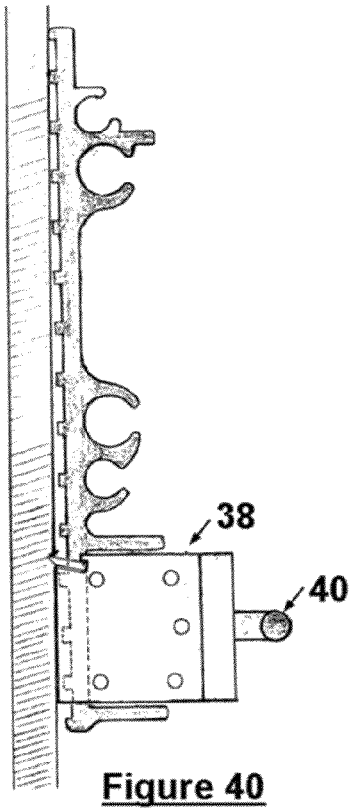
FIG. 40 is a side view showing a magnet in place in the salvage rail with the shear blade being fitted onto the magnet and the shear blade engaging the hull of the watercraft.
Figure 41:
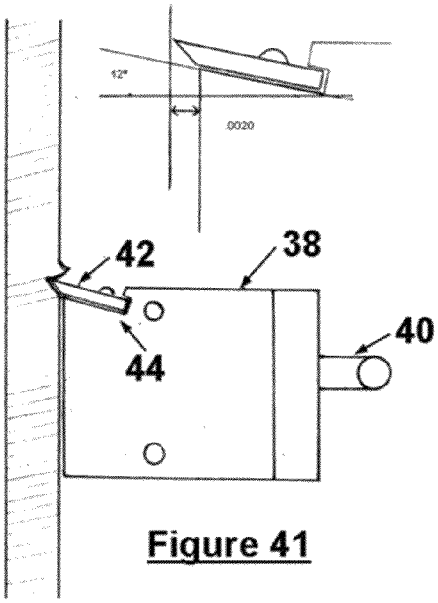
FIG. 41 is a close up view of the engagement between the edge of the shear blade and the hull of the watercraft.
Figure 42:
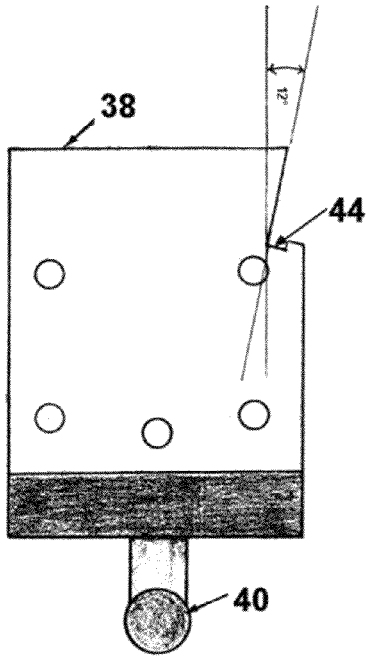
FIG. 42 is a side view of a magnet showing the notch for receiving the shear blade.
Figure 43:
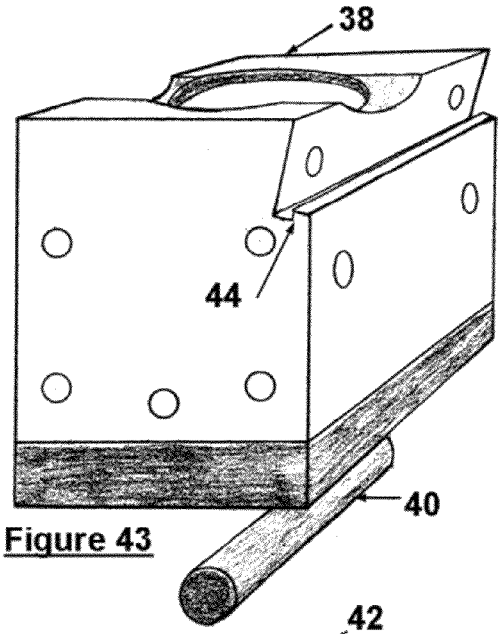
FIG. 43 is a perspective side view of a magnet showing the notch for receiving the shear blade.
Figure 44:
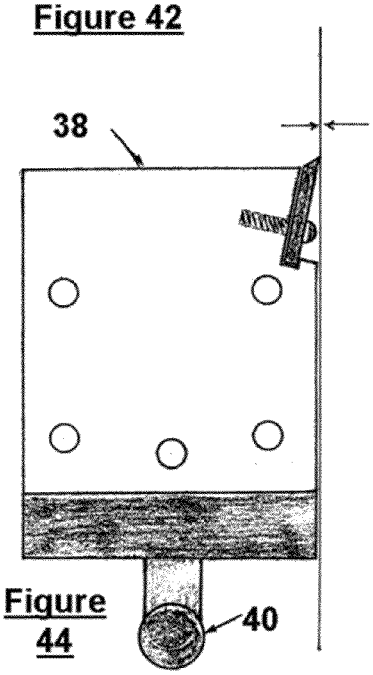
FIG. 44 is a side view of a magnet showing the notch for receiving the shear blade and the shear blade in place in the notch.
Figure 45:
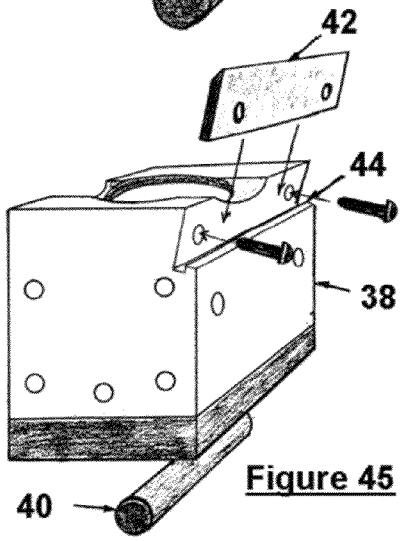
FIG. 45 is a perspective side view of a magnet showing the notch for receiving the shear blade and the shear blade being fitted into the notch and held in place with screws.

The salvage rail 12 is also designed to accommodate emergency set-ups, where time is critical in saving lives or preventing loss of property. In this case, the rail 12 can be fitted with multiple magnets 38. Rail assemblies configured in this way are ideal for stabilizing steel vessels including ships or barges, or equipment that is in peril. Prime examples include ships taking on water in the open seas, or barges that are sinking or need to be lifted from the shallows. The magnets 38 are modified with a shear blade receiving notch 44 to receive a shear blade 42 to bite into steel side walls of the target to prevent shear movement of the magnet when the target is raised. The notch is cut into the side of the magnet at an angle of about twelve degrees from vertical. Please refer to FIGS. 42 through 45. The shear blade itself comprises a 45 degree blade to cut into the target. See FIG. 38. The shear blade can be made of any suitable material, such as 440 stainless steel, for example. The shear blades are held onto the notch of the magnet by any suitable attachments, such as bolts, for example.

Rail 12 also comprises hand holds 80 for convenience in handling the rail. The hand holds 80 can be integral to the body of the rail as shown in FIGS. 18 and 28, for example. Alternatively, the hand holds 80 can be protuberant from the top edge of the rail as shown in FIGS. 2 and 23, for example.

Figure 19:
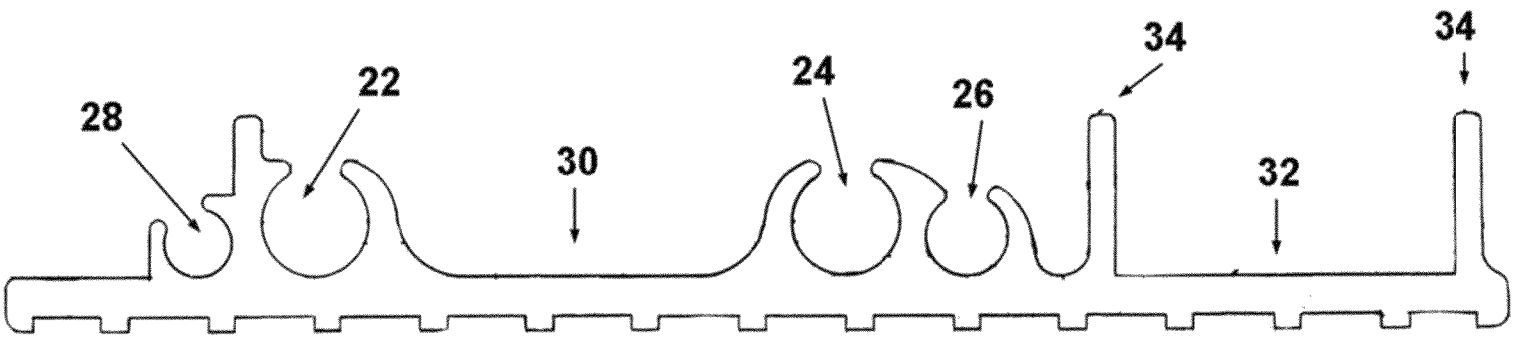
FIG. 19 is a cross-sectional view of the extruded aluminum salvage rail in the five foot size.
Figure 24:
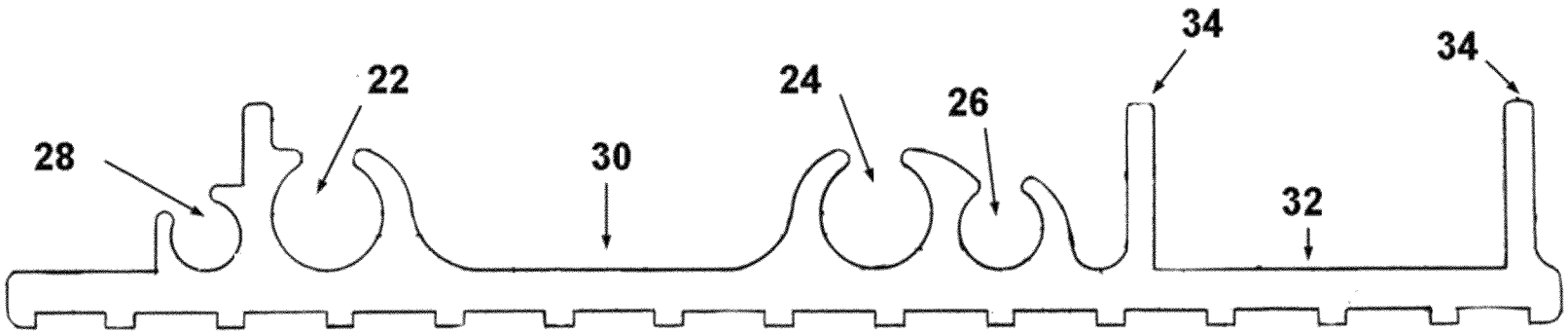
FIG. 24 is a cross-sectional view of the extruded aluminum salvage rail in the ten foot size.
Figure 29:
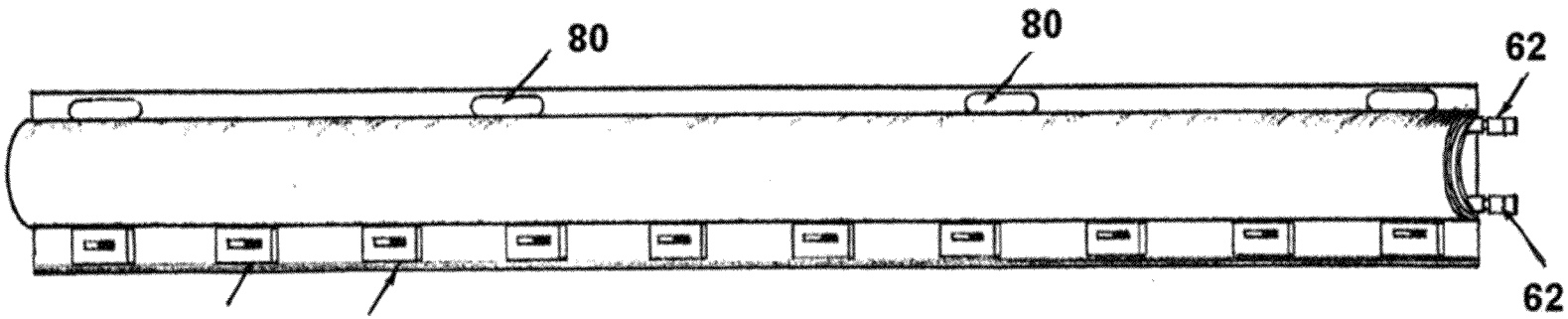
FIG. 29 is a front view showing a salvage rail with bladders rolled up showing two air manifold intake valves for each of the two rolled bladders.
Figure 46:
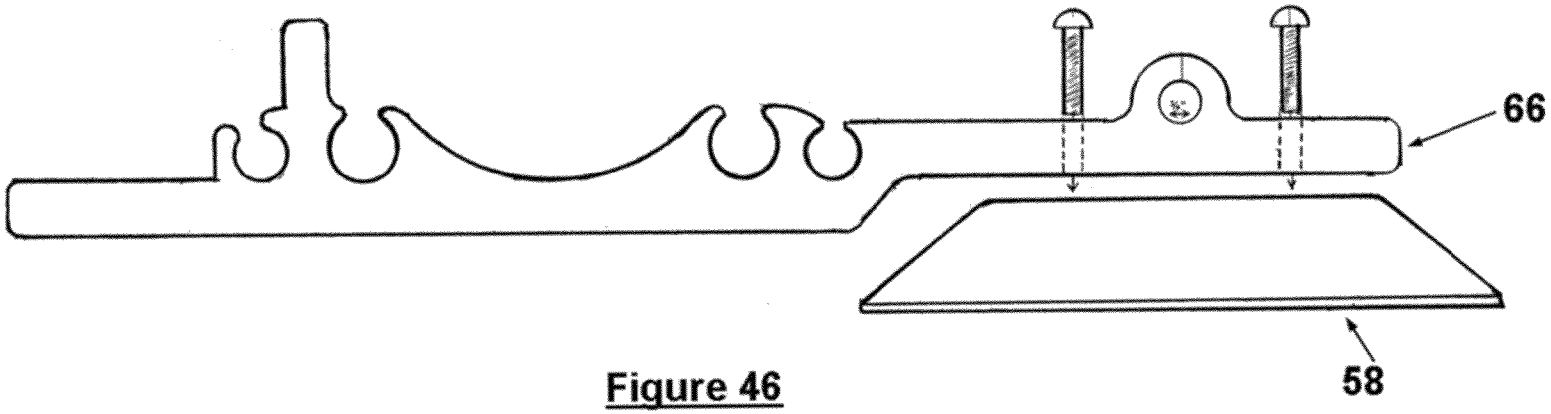
FIG. 46 is a cross-sectional view of a plastic salvage rail with a suction cup being mounted onto the suction cup mounting area of the rail. Only plastic rails are used with suction cups, as aluminum rails would scratch or otherwise damage wooden and fiberglass watercraft.
Figure 48:
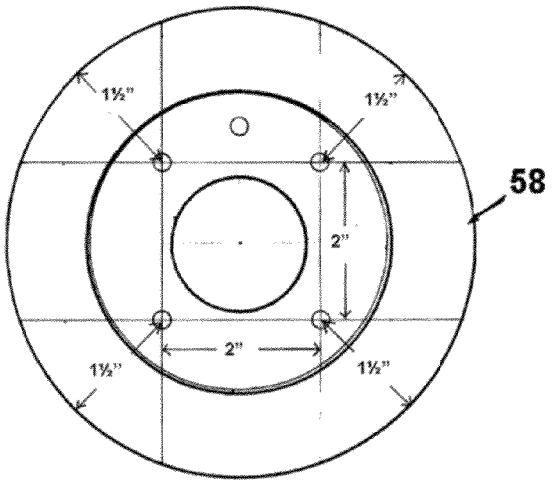
FIG. 48 is a top view of one of the suction cups.
Figure 47:
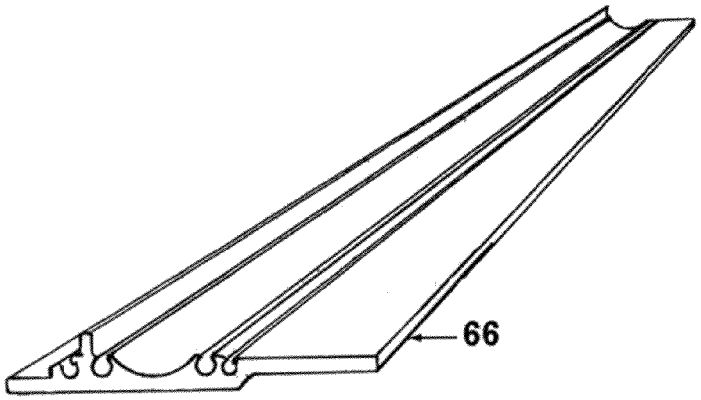
FIG. 47 is a front longitudinal perspective view of the salvage rail having a mounting area for receiving suction cups.
Figure 49:
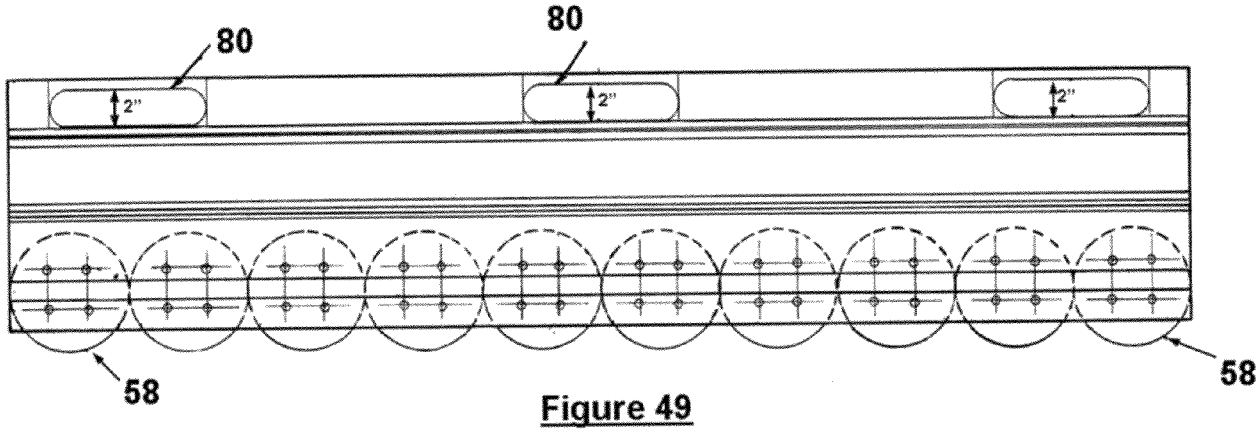
FIG. 49 is a top view of the mounting area for holding suction cups with suction cups mounted thereon.
Figure 50:
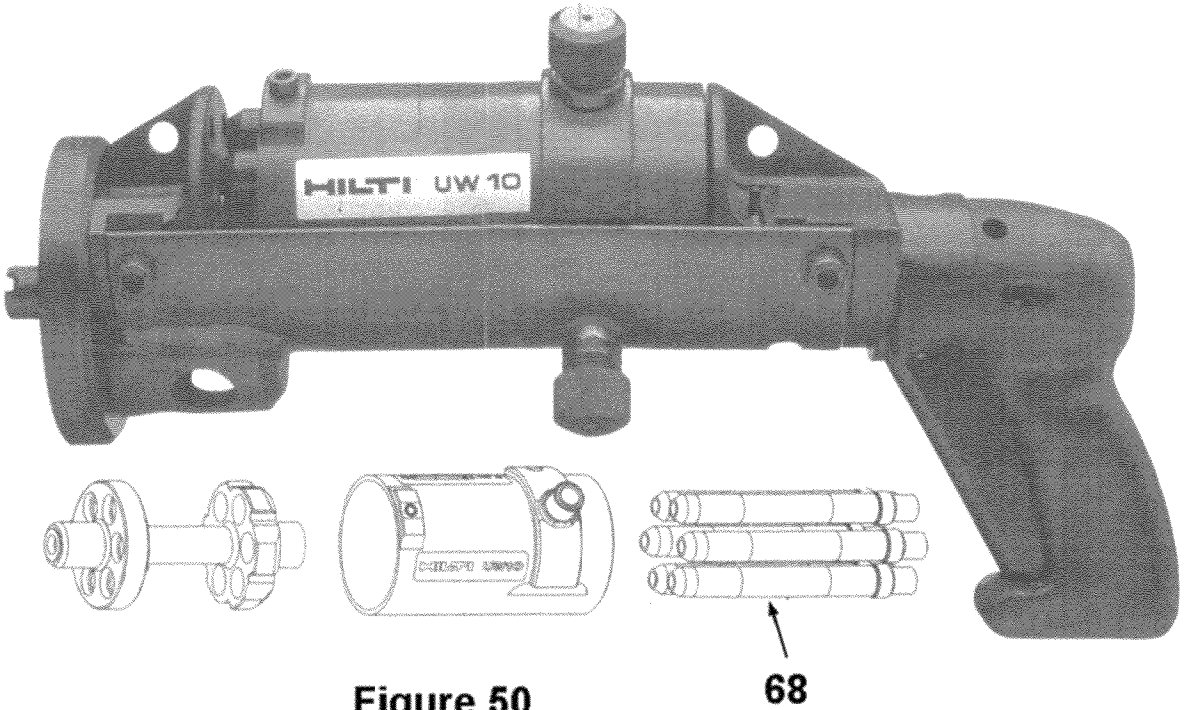
FIG. 50 is an Exploded View Showing Six HILTI™ or Other Anchor Bolts and their revolver-type magazine, which are loaded into the #Hti HILTI™ or other anchor bolt gun (also shown).
Figure 51:
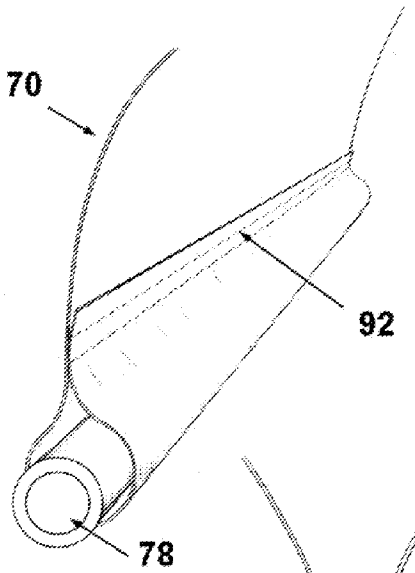
FIG. 51 is an exploded view of the releasable distal edge of the cover.
Figure 52:
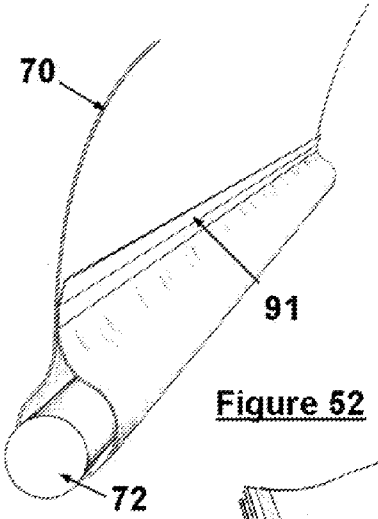
FIG. 52 is an exploded view of the distal edge of the cover.
Figure 53:
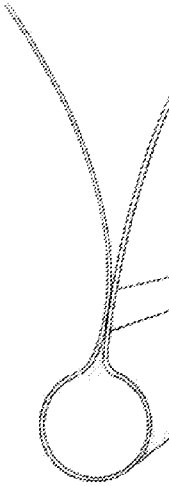
FIG. 53 is an exploded view of the hem on the bags.

Non-ferrous targets such as fiberglass and wood can be stabilized, saved, or recovered using salvage rails with powerful suction cups 58. Like the magnets, these rails also offer fast attachment and a strong hold. A salvage rail 12 prepared to accept suction cups 58 is shown in FIG. 47. Its configuration is different from the rails 12 that use magnets 38 and threaded fasteners 68, as it has no magnet holder 32, but has a suction cup 58 mounting area 66 on the back surface of the rail 12 that interfaces with the target. FIGS. 46 and 49 show suction cup 38 mounting locations. Suction cups 38 such as the six inch suction cup 58 available from Seasucker.com are suitable for this purpose. The channels for holding the bags 46, 48 and cover 70 are the same as those described above in connection with FIG. 19.

Once the rail is positioned on the target, the bladders or inflation bags can be filled, under controlled conditions, using a number of air sources. For the salvage industry that normally carries air pumps and compressors of multiple sizes, they may interface their air hoses directly with the standard-sized quick release connectors that are mounted on the salvage rail assembly. Divers may apply air from tanks or canisters to the bags as they work underwater. Or for certain applications, that is, emergency or very deep-water scenarios, pyrotechnic (explosive) devices may be used to inflate bags where no other alternatives would be as effective.

Figures 30, 31:
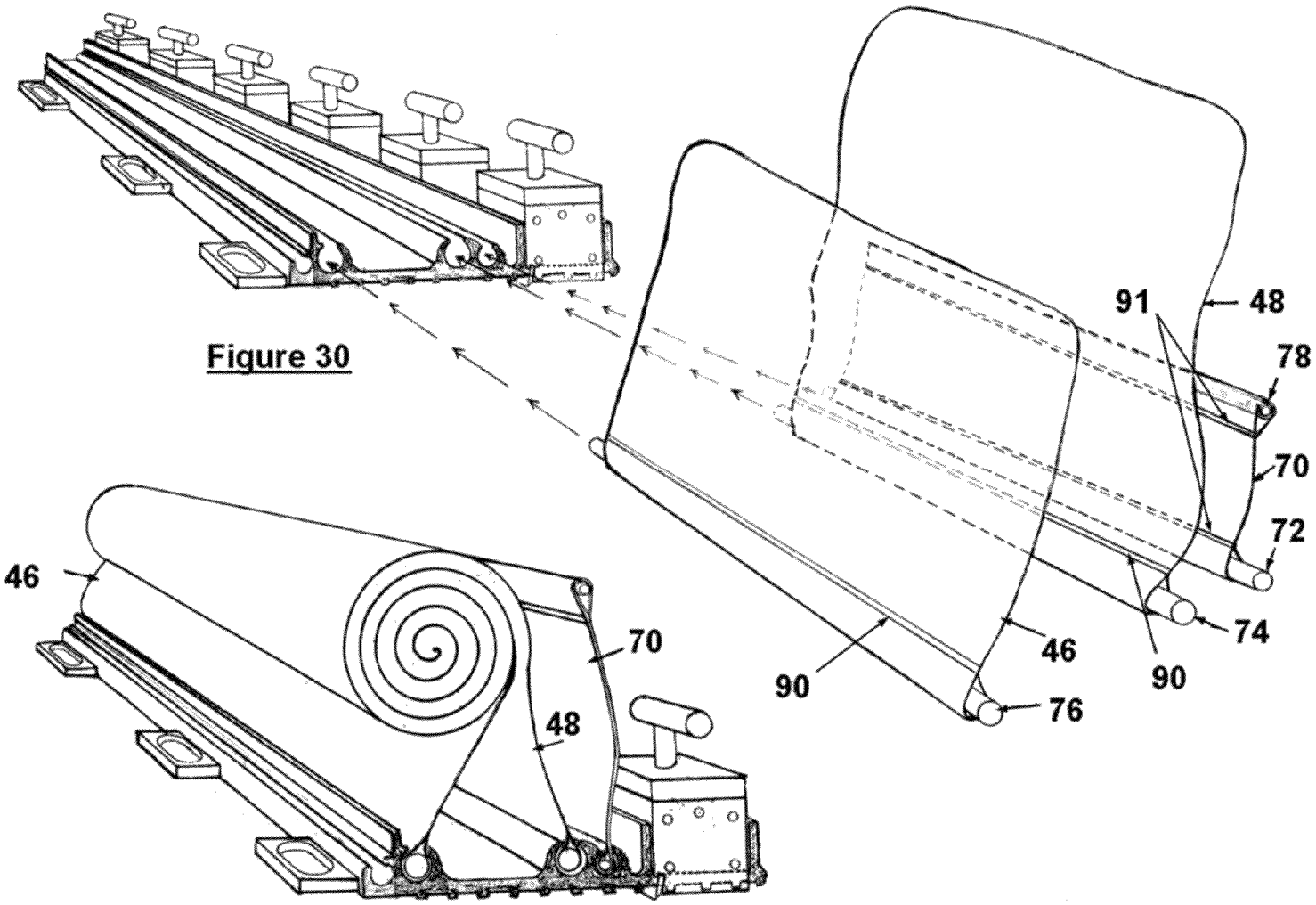
FIG. 30 is an exploded longitudinal view showing the bladders and the cover sliding into the channels on the salvage rail.
FIG. 31 is a front perspective view depicting the rolled bladders and cover completely slid into the channels on the salvage rail showing the bladders and cover slightly unrolled to show their placement in the salvage rail.

The bags, or bladders, 46, 48 are comprised of Dacron coated mold resistant PVC. This material is known in the art and is readily available from the internet at such sites as www.seattlefabrics.com. Please refer to FIG. 30. The bags 46, 48 are secured to the rail 12 by means of securing rods. Small bag rod 76 is inserted into a hem 90 on the small bag 46, while large bag rod 74 is inserted into the hem 90 of large bag 48. The bags 46, 48 with the securing rods 76, 74 inserted form two bag assemblies. The small bag assembly is inserted into the small bag containment channel 22, while the large bag assembly is inserted into the large bag containment channel 24 on the rail. To keep the rods 74, 76 in their respective containment channels, screws may be used to prevent them from sliding out of the channels. The bags 46, 48 remain secured at their proximal ends in containment channels 22, 24 during inflation. After use, the bags can be rolled up when deflated for future use. The rods, 74, 76 can be any suitable rigid or semi-rigid material, such as nylon or plastic, for example.

Figure 37:
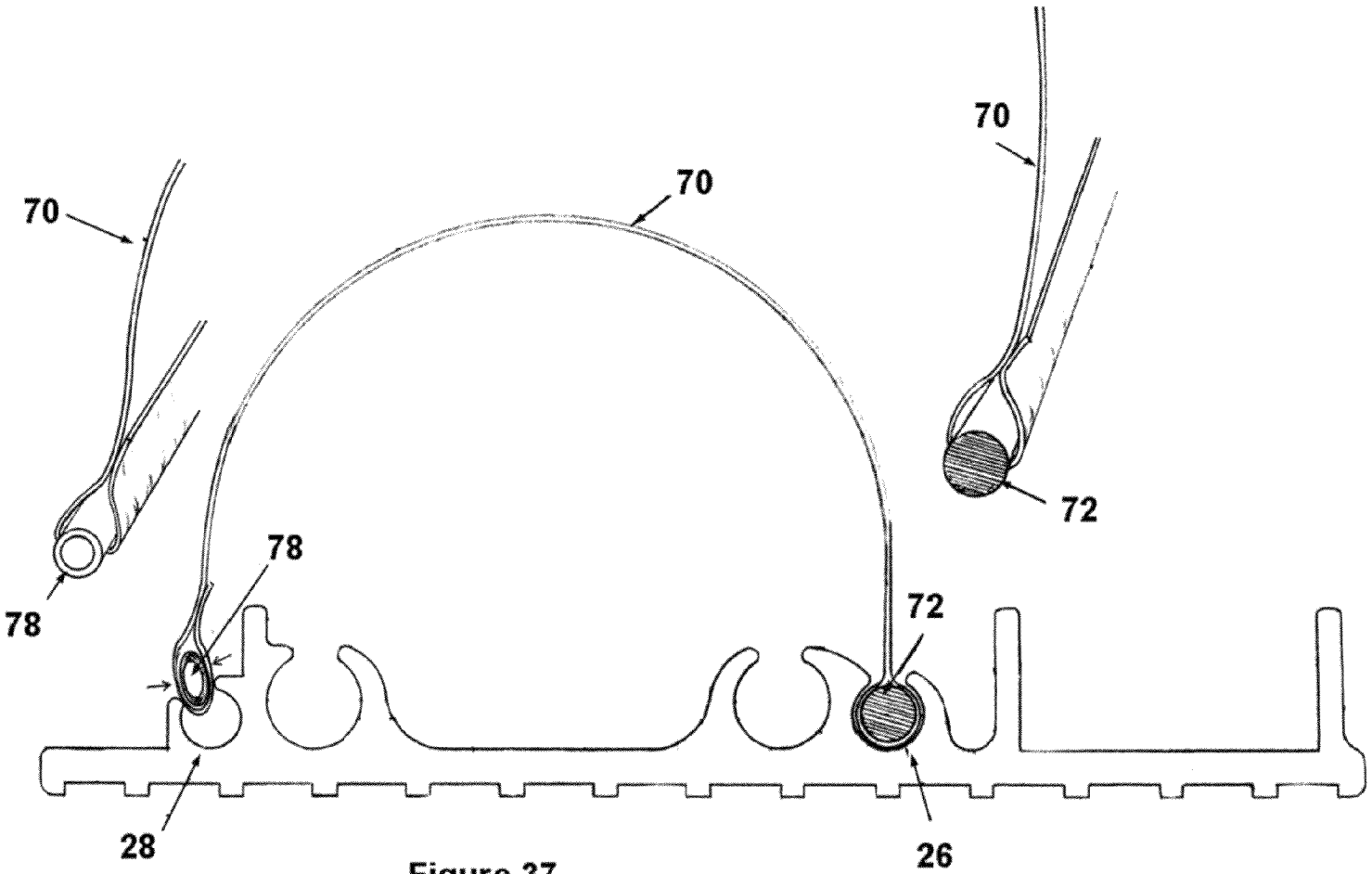
FIG. 37 provides a close up detail view of the cover with both ends engaged in their respective containment channels. The releasable cover tube located on the distal edge of the cover is squeezed to fit within the cover releasable retainment channel.

Please refer to FIG. 37. Like the bags 46, 48, cover 70 is also secured to the rail by means of a rod 72 inserted into a hem 91, 92 along the proximal edge of the cover 70. The cover 70 with the securing rod 72 included is inserted into the cover retainment channel 26 on the rail 12. The distal edge of the cover 70 contains a hem 91, 92 to receive a flexible (releasable) tube 78. The flexible tube 78 fits into the cover releasable retainment channel 28. When air is introduced into the bags, the force of the inflation causes the flexible tube 78 to be released from the cover releasable containment channel 28 thus allowing the bags to inflate.

Since it is expected that large salvage targets will definitely require multiple rails to be mounted on two or more sides, a manifold hose assembly is available that will interface between the air supply and the inflation bags of the various Salvage Rails. The manifold will allow the numerous bags to inflate at the same time, thereby keeping the target level and allowing a proper float to the surface.

Figure 34:
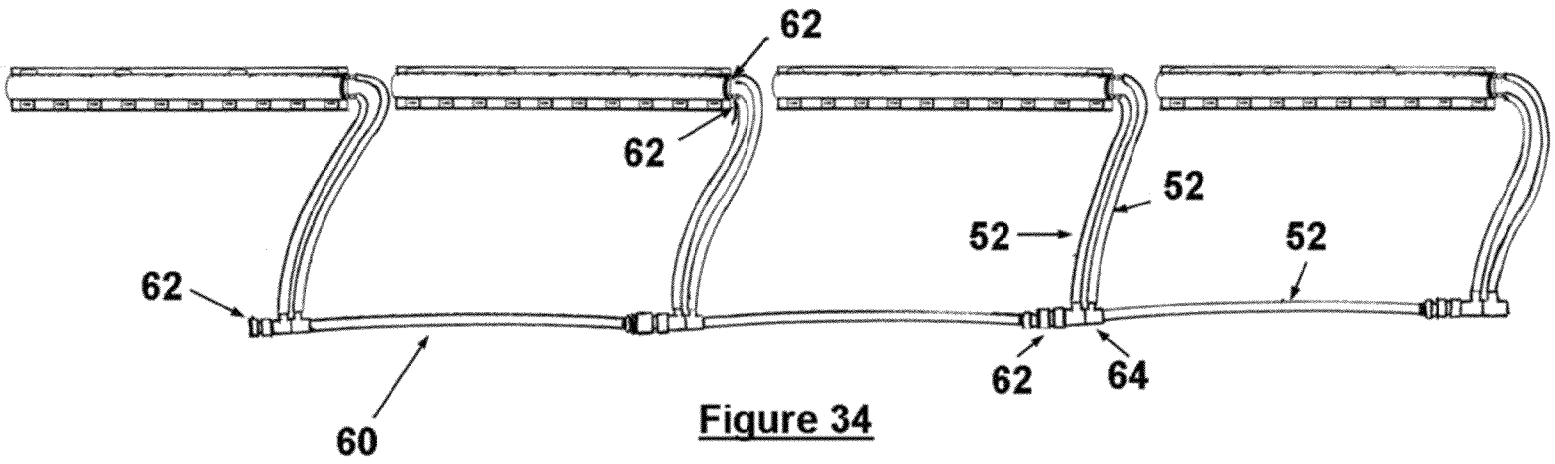
FIG. 34 is a front view showing the air intake manifold being attached to each of eight bladders, the bladders from four salvage rails.
Figure 35:
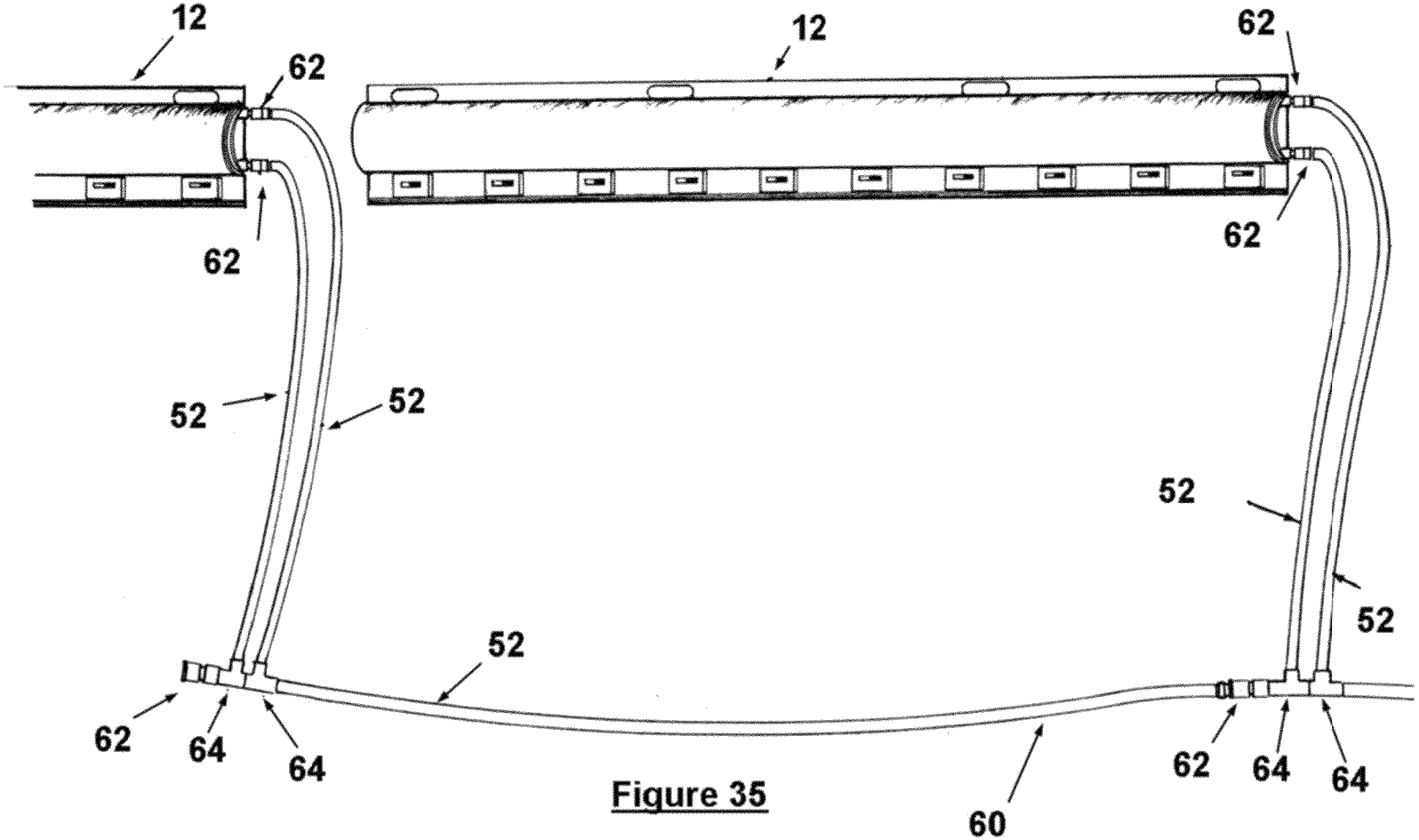
FIG. 35 is a close up view of the air intake manifold attachment to the four bladders of two salvage rails.
Figure 36:
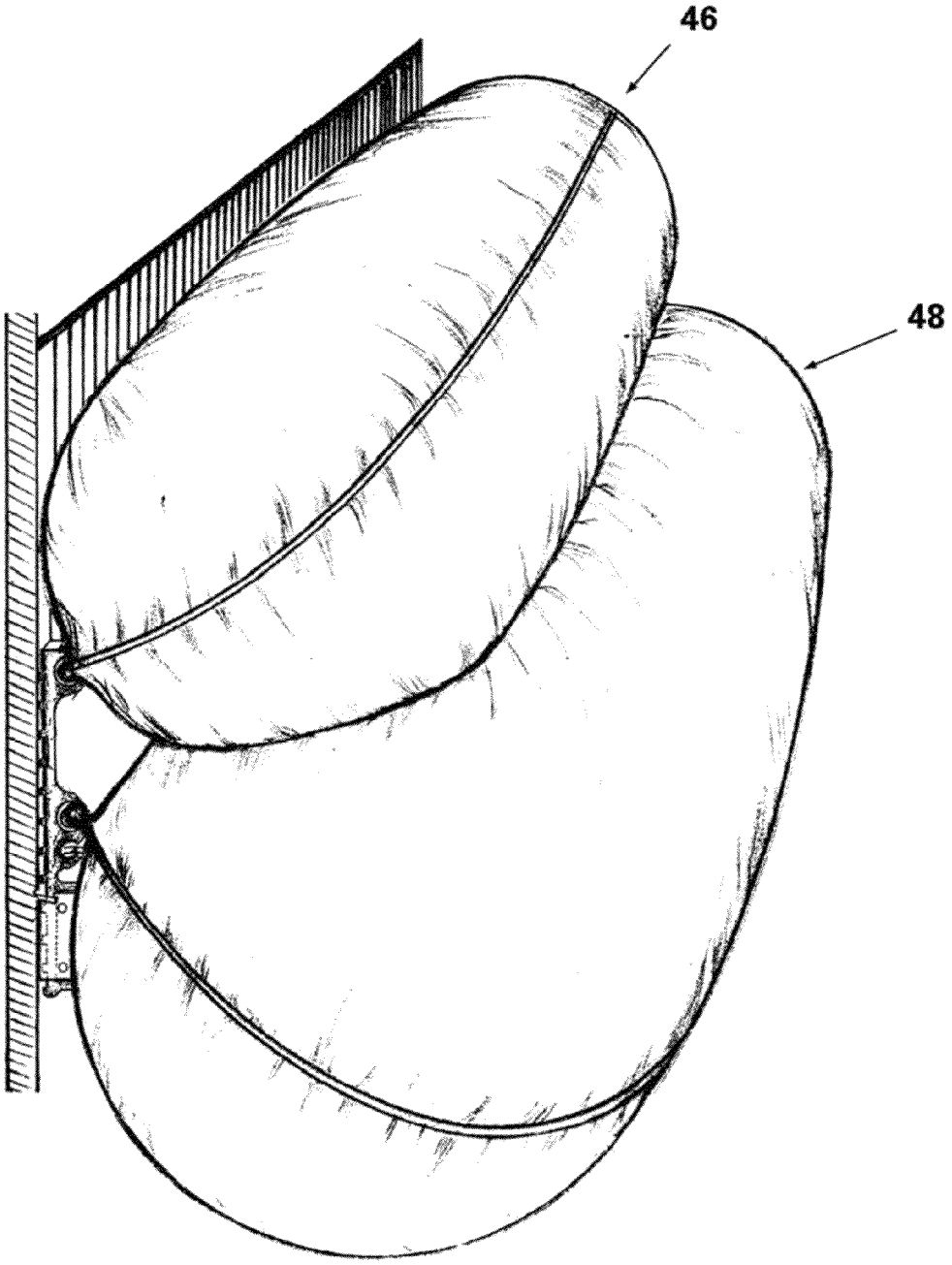
FIG. 36 is a side perspective view showing the pair of bladders inflated with the small bladder on top of the large bladder. The small bladder forces the large bladder down, lifting the watercraft higher out of the water. Channels not shown.

When air is introduced into the system, the cover 70 is released from its channel 28 and both bladders 46, 48 of each rail inflate simultaneously. Air manifold 60 is shown in FIG. 34, and in a close up view in FIG. 35. Air manifold 60 connects to the bags by means of quick connect connectors 62. The female end of the quick connect connector 62 is inserted and secured into the air intake port 54 of the bag. Two air intake ports 54 are shown in FIG. 32 and FIG. 33. However, it is envisioned that only one air intake valve may be necessary to inflate the bag. The female end of the quick connect connector 62 includes a check valve to keep the air in the bag after inflation. Each bag also includes two or more pressure relief valves 56. The air manifold assembly 60 comprises quick connect connectors 62, 64 and hoses 52. Hoses 52 connect the air manifold assembly 60 to the rail 12 bags 46, 48 via the male ends of quick connect connectors 62 of the hoses 52 that are inserted into the female ends of quick connect connectors 62 found on the ends of the salvage rail 12 bags 46, 48.

The cover 70 is rolled over both bags 46, 48 and is kept in place until inflation by means of a flexible (releasable) cover tube 78 along its distal edge. The flexible tube 78 fits into the cover retainment channel 28 in the salvage rail 12. Upon inflation, the flexible hose is forced out of the cover retainment channel 28 and the cover 70 is released and the bags 46, 48 inflate. Each bag 46, 48 has a check valve within its quick connect connector 62 to prevent egress of air from the inflated bag. Each bag 46, 48 also has pressure relief valves 56 to prevent over-inflation of the bag. Once the bags are inflated, the check valves in the connectors 62 prevent the escape of air. The inflated bags float the target, and the target is ready for towing.

Although this invention has been described with respect to specific embodiments, it is not intended to be limited thereto and various modifications which will become apparent to the person of ordinary skill in the art are intended to fall within the spirit and scope of the invention as described herein taken in conjunction with the accompanying drawings and the appended claims.

The invention claimed is:

1. A device for adding buoyancy to a target comprising:

a longitudinal salvage rail having along a width of the longitudinal salvage rail:

a channel one, a channel two, a trough formed in the longitudinal salvage rail, a channel three, a channel four; and a bag assembly having:

bag one, bag two, and a cover;

wherein bag one is smaller than bag two, and bag one has a rod which fits inside a hem along a proximal edge of bag one and fits into channel two, wherein bag one is rolled up with bag two, which bag two also has a rod which fits inside a hem along a proximal edge of bag two and fits into channel three, and the bag one rolled up with bag two rest in a trough, wherein the cover has a fixed cover rod in a hem of the cover along proximal edge of the cover, wherein the fixed cover rod fits into channel four, wherein the cover spans the bag one rolled up with bag two and has a releasable cover tube inserted into a hem at distal edge of the releasable cover tube, and wherein the releasable cover tube fits into channel one.

2. The device of claim 1 comprising extruded aluminum.

3. The device of claim 1 comprising plastic.

4. The device of claim 1 further comprising:

at least one air intake port on each bag; and at least two pressure relief valves on each bag.

5. The device of claim 1 wherein the attachment comprises at least one rare earth metal magnets.

6. The device of claim 5 wherein the at least one rare earth metal magnets comprise neodymium.

7. The device of claim 5 wherein the at least one rare earth metal magnets comprise a casing and the casing is coated with material to prevent corrosion, and a magnetic surface of the at least one rare earth metal magnets is coated with material to prevent corrosion.

8. The device of claim 1 further comprising powder actuated fasteners.

9. The device of claim 1 further comprising suction cups.

10. The device of claim 1 further comprising a combination from the group consisting of rare earth metal magnets, suction cups and powder actuated fasteners.

11. The device of claim 1, further comprising an air manifold comprising a flexible hose, the air manifold attached to each of a plurality of bags, to inflate all of the bags simultaneously.

12. The device of claim 1, further comprising one or more hand holds along a longitudinal edge of at least one of the rails to permit ease of handling and storage of the at least one of the rails.

13. An inflatable bag assembly suitable for use in a salvage rail flotation device comprising:

bag one, bag two, and a cover;

wherein bag one is smaller than bag two, and bag one has a rod which fits inside a hem along a proximal edge of bag one and fits into channel two, wherein bag one is rolled up with bag two, which bag two also has a rod which fits inside a hem along a proximal edge of bag two and fits into channel three, and the bag one rolled up with bag two rest in a trough, wherein the cover has a fixed cover rod in a hem of the cover along proximal edge of the cover, wherein the fixed cover rod fits into channel four, wherein the cover spans the bag one rolled up with bag two and has a releasable cover tube inserted into a hem at distal edge of the releasable cover tube, and wherein the releasable cover tube fits into channel one.

14. The bag of claim 13 comprising DACRON™ coated with mold resistant PVC.

15. A method for recovering a submerged target comprising:

identifying a submerged target to be recovered;

identifying rails to be utilized to recover the target, at least one of the identified rails having at least a channel one, a channel two, a trough formed therein, a channel three, and a channel four;

attaching the at least one of the identified rails to the target;

attaching an air manifold to air intake ports on a bag assembly, the bag assembly having:

bag one, bag two, and a cover;

wherein bag one is smaller than bag two, and bag one has a rod which fits inside a hem along a proximal edge of bag one and fits into channel two, wherein bag one is rolled up with bag two, which bag two also has a rod which fits inside a hem along a proximal edge of bag two and fits into channel three, and the bag one rolled up with bag two rest in a trough, wherein the cover has a fixed cover rod in a hem of the cover along proximal edge of the cover, wherein the fixed cover rod fits into channel four, wherein the cover spans the bag one rolled up with bag two and has a releasable cover tube inserted into a hem at distal edge of the releasable cover tube, and wherein the releasable cover tube fits into channel one;

inflating the bags with air; and allowing the target to float to the surface in a controlled manner.

* * * * *